US010632765B2

(12) United States Patent
Takeuchi et al.

(10) Patent No.: US 10,632,765 B2
(45) Date of Patent: Apr. 28, 2020

(54) INK JET RECORDING APPARATUS AND INK JET RECORDING METHOD

(71) Applicant: CANON KABUSHIKI KAISHA, Tokyo (JP)

(72) Inventors: Keiichirou Takeuchi, Komae (JP); Koji Inoue, Tokyo (JP); Akihiro Mouri, Fuchu (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/021,478

(22) Filed: Jun. 28, 2018

(65) Prior Publication Data

US 2019/0009578 A1 Jan. 10, 2019

(30) Foreign Application Priority Data

Jul. 4, 2017 (JP) ..... 2017-131280

(51) Int. Cl.

| | |
|---|---|
| ***B41J 2/165*** | (2006.01) |
| ***B41J 11/00*** | (2006.01) |
| ***B41J 2/01*** | (2006.01) |
| ***B41J 29/17*** | (2006.01) |
| ***B41J 2/005*** | (2006.01) |

(52) U.S. Cl.

CPC ..... *B41J 11/007* (2013.01); *B41J 2/0057* (2013.01); *B41J 2/01* (2013.01); *B41J 29/17* (2013.01); *B41J 2002/012* (2013.01)

(58) Field of Classification Search

USPC ..... 347/102, 30

See application file for complete search history.

(56) References Cited

U.S. PATENT DOCUMENTS

| | | | | |
|---|---|---|---|---|
| 5,640,655 | A * | 6/1997 | Shoji | G03G 15/11 15/256.52 |
| 7,845,760 | B2 * | 12/2010 | Hirakawa | B41J 2/0057 347/30 |
| 9,656,459 | B2 | 5/2017 | Kuwabara et al. | |
| 2017/0217191 | A1 | 8/2017 | Hirokawa et al. | |
| 2017/0217216 | A1 | 8/2017 | Ohnishi et al. | |
| 2018/0311951 | A1 | 11/2018 | Sakamoto et al. | |
| 2018/0319179 | A1 | 11/2018 | Yamane et al. | |
| 2018/0326755 | A1 | 11/2018 | Ohnishi et al. | |
| 2018/0326756 | A1 | 11/2018 | Hirokawa et al. | |
| 2019/0009550 | A1 | 1/2019 | Inoue et al. | |
| 2019/0009579 | A1 | 1/2019 | Inoue et al. | |

FOREIGN PATENT DOCUMENTS

| | | |
|---|---|---|
| JP | 2001-179959 A | 7/2001 |
| JP | 2009-045851 A | 3/2009 |

* cited by examiner

*Primary Examiner* — Lam S Nguyen
(74) *Attorney, Agent, or Firm* — Venable LLP

(57) ABSTRACT

An ink jet recording apparatus includes: an image forming unit for forming an ink image containing a liquid component and a coloring material on a moving ink receiving medium; and a liquid absorbing unit having a liquid absorbing member which absorbs at least a part of the liquid component from the ink image by coming into contact with the ink image on the ink receiving medium, in which, in a moving direction of the ink receiving medium, a curvature radius R1 of the ink receiving medium at a contact start position between the liquid absorbing member and the ink image and a curvature radius R2 of the liquid absorbing member at the contact start position satisfy a relationship in which R1>0, R2<0, and |R1|≤|R2|.

11 Claims, 9 Drawing Sheets

INK JET RECORDING APPARATUS AND INK JET RECORDING METHOD

BACKGROUND OF THE INVENTION

Field of the Invention

The present invention relates to an ink jet recording apparatus and an ink jet recording method.

Description of the Related Art

In the ink jet recording method, a liquid composition (ink) containing a coloring material is directly or indirectly applied onto a recording medium such as paper so that an image (ink image) is formed. At this time, due to the recording medium excessively absorbing a liquid component in the ink image, curling or cockling may occur. Thus, as a method of removing the liquid component contained in the ink image, a method was proposed in which a roller-shaped porous body is brought into contact with an ink image and the liquid component is absorbed and removed from the ink image (Japanese Patent Application Laid-Open No. 2009-45851). In addition, a method was proposed in which a belt-shaped polymer absorber is brought into contact with the ink image and the liquid component is absorbed and removed from the ink image (Japanese Patent Application Laid-Open No. 2001-179959).

In a case where a roller-shaped or belt-shaped liquid absorbing member as disclosed in Japanese Patent Application Laid-Open No. 2009-45851 or Japanese Patent Application Laid-Open No. 2001-179959 is used for the absorption and removal of a liquid component from an ink image, a nip portion in which a liquid absorbing member and an ink receiving medium come into contact with each other is formed and the liquid component is absorbed and removed as the ink image passes through the nip portion. However, in this case, when the ink image and the liquid absorbing member are in contact with each other, a so-called "smeared image" may be generated in which parts of the liquid component, the coloring material, the solid content other than the coloring material, and the like in the ink image are pushed to the image rear side and a satisfactory image may not be obtained.

An object of the present invention is to provide an ink jet recording apparatus and an ink jet recording method capable of suppressing smeared images and forming a satisfactory image.

SUMMARY OF THE INVENTION

An ink jet recording apparatus according to the present invention includes an image forming unit for forming an ink image containing a liquid component and a coloring material on a moving ink receiving medium, and a liquid absorbing unit having a liquid absorbing member which absorbs at least a part of the liquid component from the ink image by coming into contact with the ink image on the ink receiving medium, in which, in a moving direction of the ink receiving medium, a curvature radius R1 of the ink receiving medium at a contact start position between the liquid absorbing member and the ink image and a curvature radius R2 of the liquid absorbing member at the contact start position satisfy a relationship in which $R1<0$, $R2<0$, and $|R1|\leq|R2|$.

In addition, an ink jet recording apparatus according to the present invention includes an image forming unit for forming an ink image containing a liquid component and a coloring material on a moving ink receiving medium, and a liquid absorbing unit having a liquid absorbing member which absorbs at least a part of the liquid component from the ink image by coming into contact with the ink image on the ink receiving medium, in which, in a moving direction of the ink receiving medium, a curvature radius R1 of the ink receiving medium at a contact start position between the liquid absorbing member and the ink image and a curvature radius R2 of the liquid absorbing member at the contact start position satisfy a relationship in which $R1<0$, $R2>0$, and $|R1|\geq|R2|$.

Further features of the present invention will become apparent from the following description of exemplary embodiments with reference to the attached drawings.

DESCRIPTION OF THE EMBODIMENTS

Figure 1:
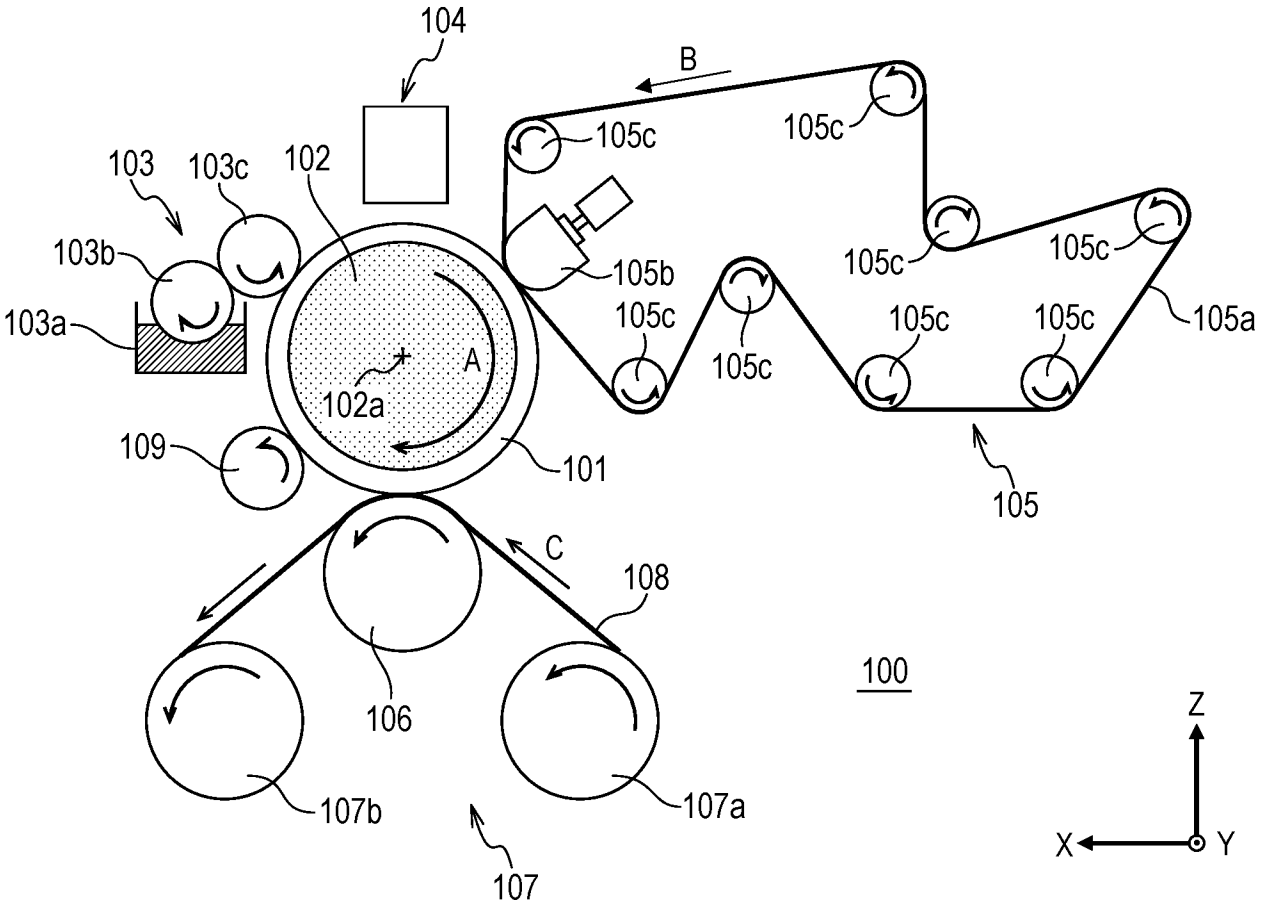
FIG. 1 is a schematic diagram illustrating one example of a configuration of a transfer type ink jet recording apparatus in a case where a curvature radius R1 of an ink receiving medium at a contact start position between a liquid absorbing member and an ink image is positive in one embodiment of the present invention.

Preferred embodiments of the present invention will now be described in detail in accordance with the accompanying drawings.

An ink jet recording apparatus according to the present invention is provided with the following configuration: an image forming unit for forming an ink image containing a liquid component and a coloring material on a moving ink receiving medium; and a liquid absorbing unit having a liquid absorbing member which absorbs at least a part of the liquid component from the ink image by coming into contact with the ink image on the ink receiving medium. Here, in a moving direction of the ink receiving medium, a curvature radius R1 of the ink receiving medium at a contact start position between the liquid absorbing member and the ink image and a curvature radius R2 of the liquid absorbing member at the contact start position satisfy a relationship (1) or (2) below.

$$R1>0,\ R2<0,\ \text{and}\ |R1|\leq R2|. \quad (1)$$

$$R1<0,\ R2>0,\ \text{and}\ |R1|\geq R2|. \quad (2)$$

An ink jet recording method according to the present invention has the following steps: an image forming step of forming an ink image containing a liquid component and a coloring material on a moving ink receiving medium; and a liquid absorbing step of absorbing at least a part of the liquid component from the ink image by bringing a liquid absorbing member into contact with the ink image on the ink receiving medium. Here, in a moving direction of the ink receiving medium, a curvature radius R1 of the ink receiving medium at a contact start position between the liquid absorbing member and the ink image and a curvature radius R2 of the liquid absorbing member at the contact start position satisfy the relationship (1) or (2).

In a case where at least a part of the liquid component is absorbed and removed from the ink image using the liquid absorbing member, since the flow resistance of the liquid absorbing member with respect to the ink image containing the liquid component is large, it may not be possible to sufficiently absorb the liquid component from the ink image and the ink image may be swept to one end, causing smeared images. In particular, in a case of applying pressure by passing an ink image through a nip portion formed by a liquid absorbing member having a curved shape and an ink receiving medium, in a process in which a region where an ink image is formed on the ink receiving medium enters the nip portion, a force acts in the direction in which the ink image is swept and the smeared image becomes more remarkable.

As a result of intensive studies, the present inventors found that, by optimizing the relationship between the curvature radius of the ink receiving medium and the curvature radius of the liquid absorbing member at the contact start position between the ink image and the liquid absorbing member (also referred to below as the contact start position), smeared images are suppressed and it is possible to form satisfactory images. That is, in the present invention, the curvature radius R1 of the contact surface of the ink receiving medium with the liquid absorbing member and the curvature radius R2 of the contact surface of the liquid absorbing member with the ink receiving medium at the contact start position between the ink image and the liquid absorbing member satisfying the relationship of (1) or (2) described above make it possible to suppress smeared images. The curvature radii R1 and R2 having positive/negative relationship with each other make it possible to prevent convex parts of the ink receiving medium and the liquid absorbing member from contacting each other and high pressure is not applied at the time of contact, thus, it is possible to suppress smeared images. In addition, the absolute values of the curvature radii R1 and R2 satisfying the relationship of (1) or (2) described above make it possible to prevent the end portion of the arc of the liquid absorbing member from contacting the ink receiving medium at the contact start position and high pressure is not applied at the time of contact, thus, it is possible to suppress smeared images. A detailed description will be given below of the present invention with reference to preferable embodiments.

A description will be given below of the ink jet recording apparatus according to an embodiment of the present invention with reference to the drawings. Examples of the ink jet recording apparatus of the present embodiment contain the following two ink jet recording apparatuses: an ink jet recording apparatus which forms an ink image by discharging ink onto a transfer body as an ink receiving medium and transfers the ink image to a recording medium after liquid component removal from the ink image with a liquid absorbing member; and an ink jet recording apparatus which forms an ink image on a recording medium such as paper or cloth as an ink receiving medium and absorbs and removes a liquid component from the ink image on the recording medium with a liquid absorbing member. In the present invention, the former ink jet recording apparatus is referred to below as a transfer type ink jet recording apparatus for the sake of convenience and the latter ink jet recording apparatus is referred to below as a direct drawing type ink jet recording apparatus for the sake of convenience. Below, in the respective ink jet recording apparatuses, a description will be given separately of a case where the curvature radius R1 of the ink receiving medium at the contact start position between the liquid absorbing member and the ink image in the moving direction of the ink receiving medium is positive and a case where the curvature radius R1 is negative.

Figure 2:
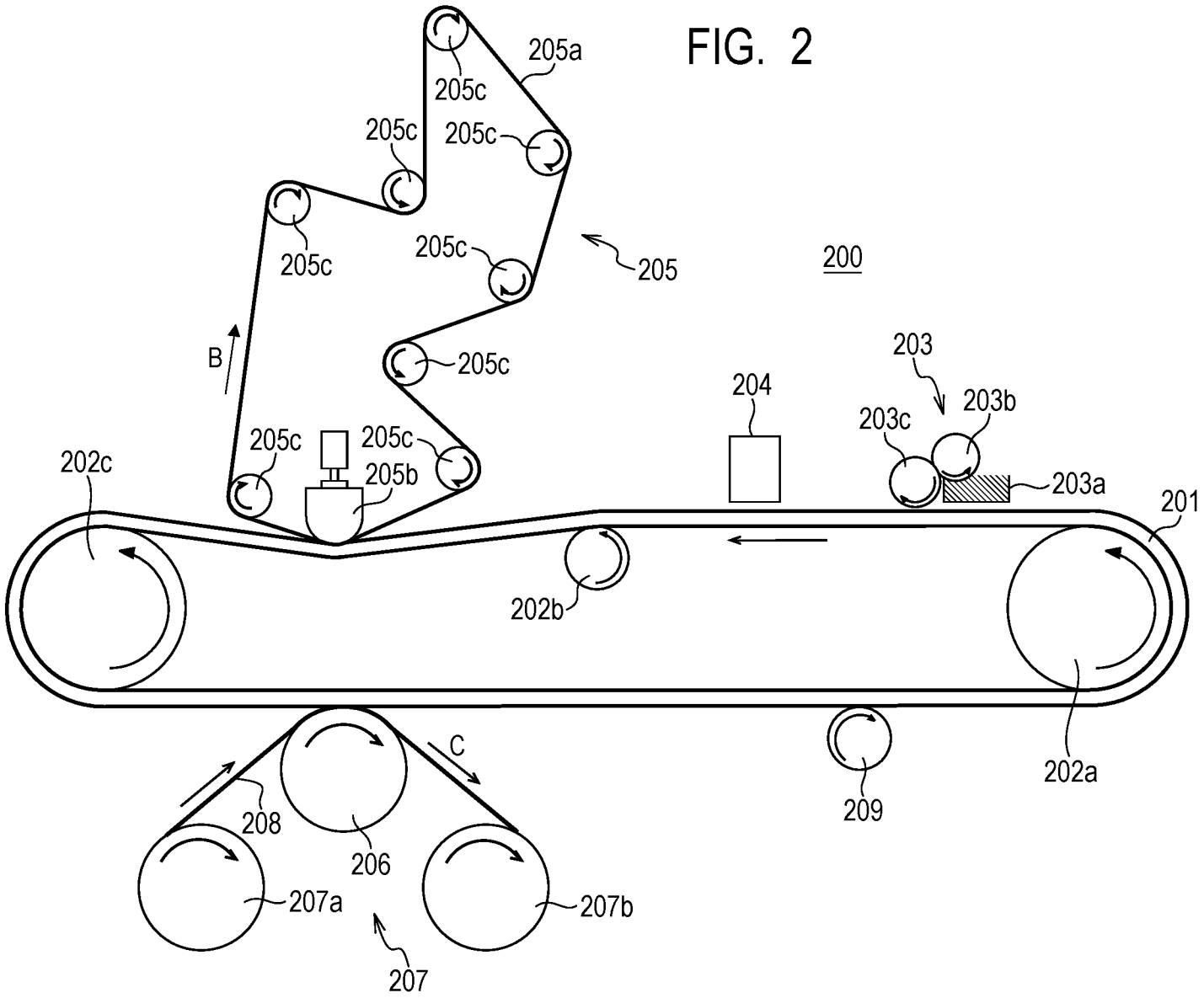
FIG. 2 is a schematic diagram illustrating one example of a configuration of a transfer type ink jet recording apparatus in a case where a curvature radius R1 of an ink receiving medium at a contact start position between a liquid absorbing member and an ink image is negative in one embodiment of the present invention.

Transfer Type Ink Jet Recording Apparatus when Curvature Radius R1 of Ink Receiving Medium is Positive at Contact Start Position Between Liquid Absorbing Member and Ink Image FIG. 1 is a schematic diagram illustrating one example of a schematic configuration of a transfer type ink jet recording apparatus 100, which is the transfer type ink jet recording apparatus according to the present embodiment, in which a curvature radius R1 of an ink receiving medium is positive at a contact start position between a liquid absorbing member and an ink image. The transfer type ink jet recording apparatus 100 shown in FIG. 1 is a single-wafer type ink jet recording apparatus which manufactures recorded matter by transferring an ink image to a recording medium 108 through a transfer body 101. In FIG. 2, the X direction, the Y direction, and the Z direction respectively indicate the width direction (full length direction), the depth direction, and the height direction of the transfer type ink jet recording apparatus 100. The recording medium 108 is conveyed in the X direction.

The transfer type ink jet recording apparatus 100 shown in FIG. 1 has the following configuration: a transfer body 101 supported by a support member 102; a reaction liquid applying device 103 for applying a reaction liquid which reacts with ink on the transfer body 101; an ink applying device 104 provided with an ink jet head for applying ink to the transfer body 101 to which the reaction liquid is applied and forming an ink image, which is an image using ink, on the transfer body 101; a liquid removing device 105 for removing a liquid component from the ink image on the transfer body 101; and a pressing member 106 for transferring which transfers the ink image on the transfer body 101 after liquid removal onto a recording medium 108, which is paper or the like. In addition, the transfer type ink jet recording apparatus 100 may have a cleaning member 109 for a transfer body for cleaning the surface of the transfer body 101 after transfer, as necessary. Here, the transfer body 101, the reaction liquid applying device 103, the ink jet head of the ink applying device 104, the liquid removing device 105, and the cleaning member 109 for a transfer body each have lengths in the Y direction which correspond to the recording medium 108 to be used.

The transfer body 101 rotates centering around a rotation axis 102*a* of the support member 102 in the direction of the arrow A in FIG. 1. The rotation of the support member 102 moves the transfer body 101. In sequence, on the moving transfer body 101, the reaction liquid is applied by the reaction liquid applying device 103 and the ink is applied by the ink applying device 104 and an ink image is formed on the transfer body 101. That is, in the present embodiment, the reaction liquid applying device 103 and the ink applying device 104 correspond to an image forming unit. The movement of the transfer body 101 moves the ink image formed on the transfer body 101 up to a position coming into contact with a liquid absorbing member 105*a* of the liquid removing device 105 which is a liquid absorbing unit.

The liquid absorbing member 105*a* moves in synchronization with the rotation of the transfer body 101. The ink image formed on the transfer body 101 passes through a state of being in contact with the liquid absorbing member 105*a* which moves in the direction of the arrow B. In this contact state, the liquid absorbing member 105*a* is pressed at a predetermined pressure by a liquid absorbing pressing member 105*b* from a surface opposite to the surface in contact with the ink image, abuts against the ink image, and absorbs and removes the liquid component from the ink image on the transfer body 101.

The removal of the liquid component can be expressed from a different point of view as concentrating the ink constituting the ink image formed on the transfer body 101. Concentrating the ink means that the proportion of the solid content contained in the ink, such as coloring material and resin, with respect to the liquid component contained in the ink increases owing to reduction in the liquid component.

Here, the liquid absorbing member 105*a* does not necessarily need to be in contact with the transfer body 101 as long as the liquid absorbing member 105*a* is in contact with at least the ink image in order to absorb the liquid component from the ink image; however, in the present embodiment, a configuration in which the liquid absorbing member 105*a* is in contact with the transfer body 101 is used.

Then, the ink image after liquid removal from which the liquid component is removed is in a state in which the ink is concentrated in comparison with the ink image before liquid removal and, due to the movement of the transfer body 101, is moved to a transfer portion which is in contact with the recording medium 108 which is conveyed in the direction of the arrow C by a conveyance device for recording medium 107. While the ink image after liquid removal is in contact with the recording medium 108, the pressing member 106 for transferring presses the transfer body 101 to transfer the ink image onto the recording medium 108. The ink image transferred onto the recording medium 108 is a reverse image of the ink image before liquid removal and the ink image after liquid removal.

Here, after the reaction liquid is applied on the transfer body 101, ink is applied to form an ink image, thus, the reaction liquid remains without reacting with the ink in a non-image region where no ink image is formed. In the present invention, the liquid absorbing member 105*a* contacts not only the ink image but also the unreacted reaction liquid, and also removes the liquid component of the reaction liquid. Accordingly, the above description expresses that the liquid component is removed from the ink image; however, this does not mean limited to removing the liquid component only from the ink image, but that it is only necessary to remove the liquid component from at least the ink image on the transfer body 101. Here, the liquid component is not particularly limited as long as the liquid component has fluidity without having a certain shape and has a substantially constant volume. Examples of liquid components contain water and organic solvents contained in the ink and the reaction liquid. A description will be given below of each configuration of the transfer type ink jet recording apparatus.

Transfer Body

It is possible for the transfer body to have a surface layer containing an ink image forming surface. As the material of the surface layer, it is possible to appropriately use various materials such as resin and ceramics, but a material having high compressive elastic modulus is preferable from the viewpoint of durability and the like. Specifically, examples thereof contain an acrylic resin, an acrylic silicone resin, a fluorine-containing resin, a condensate obtained by condensing a hydrolyzable organosilicon compound, and the like. In order to improve the wettability, transferability, and the like of the reaction liquid, a surface treatment may be carried out thereon before use. Examples of surface treatments contain a frame treatment, a corona treatment, a plasma treatment, a polishing treatment, a roughening treatment, an active energy ray irradiation treatment, an ozone treatment, a surfactant treatment, a silane coupling treatment, and the like. A plurality of the above may be combined. In addition, it is also possible to provide an arbitrary surface shape on the surface layer.

In addition, the transfer body preferably has a compressible layer having a function of absorbing pressure variations. By providing the compressible layer, the compressible layer absorbs deformation, disperses fluctuations with respect to local pressure fluctuations, and is able to maintain good transferability even during high-speed printing. Examples of the material of the compressible layer contain acrylonitrile-butadiene rubber, acrylic rubber, chloroprene rubber, urethane rubber, silicone rubber, and the like. A rubber material is preferable in which, at the time of molding these rubber materials, a predetermined amount of a vulcanizing agent, a vulcanization accelerator and the like are blended therein and a filler such as a foaming agent, hollow particles, or salt is further blended therein as necessary to make a porous material. Due to this, with respect to various pressure fluctuations, bubble portions are compressed along with volume changes, thus, deformation in directions other than the compression direction is small and it is possible to obtain more stable transferability and durability. As the porous rubber material, there are materials having a continuous pore structure in which each pore is continuous to each other and materials having an independent pore structure in which each pore is independent from each other. In the present invention, either structure may be used, and these structures may be used in combination.

Furthermore, the transfer body preferably has an elastic layer between the surface layer and the compressible layer. As a material of the elastic layer, it is possible to appropriately use various materials such as resin, ceramics, and the like. Various elastomer materials and rubber materials are preferably used from the viewpoint of processing characteristics and the like. Specific examples thereof contain fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, copolymers of ethylene/propylene/ butadiene, nitrile butadiene rubber, and the like. In particular, silicone rubber, fluorosilicone rubber, and phenyl silicone rubber have a low compression set, thus are preferable in terms of dimensional stability and durability. In addition, the above have small changes in the elastic modulus depending on the temperature, which is also preferable in view of transferability.

Various types of adhesive agent or double-sided tape may be used between each layer forming the transfer body (surface layer, elastic layer, and compressible layer) in order to fix and hold the layers. In addition, a reinforcing layer having a high compressive elastic modulus may be provided to suppress lateral elongation when mounted on an apparatus and to maintain elasticity. In addition, woven fabric may be used as a reinforcing layer. It is possible to produce a transfer body by arbitrarily combining each layer made of the above materials.

It is possible to freely select the size of the transfer body according to the intended print image size. There are no particular restrictions on the shape of the transfer body, and specific examples thereof contain a sheet shape, a roller shape, a belt shape, an endless web shape, and the like.

Support Member

It is possible to support the transfer body on the support member 102 as shown in FIG. 1. As a method of supporting the transfer body, various types of adhesive or double-sided tape may be used. Alternatively, the transfer body may be supported on the support member using an installation member by attaching an installation member formed of a material such as metal, ceramics, resin, or the like to the transfer body.

The support member requires a certain level of structural strength from the viewpoints of conveyance precision and durability. For the material of the support member, metal, ceramics, resin, or the like is preferably used. Among these, in particular, the following materials are preferably used in order to improve the rigidity able to withstand pressurization at the time of transfer and dimensional precision as well as the responsiveness of control by reducing inertia at the time of operation. These are aluminum, iron, stainless steel, acetal resin, epoxy resin, polyimide, polyethylene, polyethylene terephthalate, nylon, polyurethane, silica ceramics, and alumina ceramics. In addition, it is also preferable to use a combination of the above.

Figure 8:
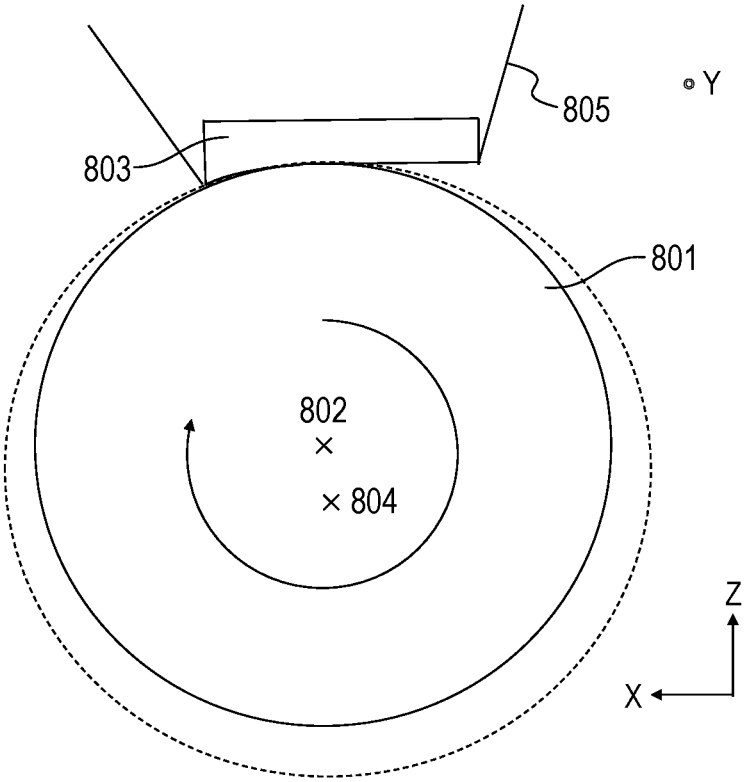
FIG. 8 is a schematic diagram illustrating a state when an ink receiving medium and a liquid absorbing member are in contact in the transfer type ink jet recording apparatus shown in FIG. 1.

In addition, in the transfer type ink jet recording apparatus shown in FIG. 1, the shape of the support member 102 which supports the transfer body 101 is set such that the curvature radius R1 of the transfer body 101 is positive at the contact start position between the liquid absorbing member 105*a* and the ink image. FIG. 8 is a conceptual diagram illustrating a state when the transfer body 101 and the liquid absorbing member 105*a* come into contact with each other in the transfer type ink jet recording apparatus shown in FIG. 1. FIG. 8 is a cross-sectional diagram illustrating the same direction as in FIG. 1 and shows a shape in which the cross-sectional shape is maintained in the Y direction. An ink receiving medium 801 is represented in a state in which the transfer body is supported on the surface of the support member. 802 represents a center of a circle with the curved surface of the ink receiving medium 801 as an arc when the ink receiving medium 801 starts contact with a liquid absorbing member 805 by being pressed by a liquid absorbing pressing member 803. Regarding the definition of positive and negative for the curvature radius, the above is defined by whether the center of the circle is inside or outside the object, and since the circle center 802 is inside the ink receiving medium 801, the curvature radius R1 of the ink receiving medium 801 in FIG. 8 is positive. That is, as shown in FIG. 8, the curved surface of the ink receiving medium 801 at the contact start position has a convex shape with respect to the liquid absorbing member 805. In a case of setting the support member to have such a shape, it is conceivable to form the desired shape on the surface which comes into contact with the liquid absorbing member, for example, as shown in FIG. 1, by using the support member 102 with a cylindrical shape, or by using a belt-shaped support member and using a roll.

Reaction Liquid Applying Device

It is possible for the transfer type ink jet recording apparatus to have a reaction liquid applying device which applies a reaction liquid to a transfer body. The reaction liquid applying device 103 shown in FIG. 1 indicates a gravure offset roller having a reaction liquid container 103*a* which contains a reaction liquid and reaction liquid applying units 103*b* and 103*c* which apply the reaction liquid in the reaction liquid container 103*a* to the transfer body 101. However, the reaction liquid applying device may be any device capable of applying the reaction liquid to the transfer body, and it is possible to appropriately use various kinds of devices known in the related art. Other than the gravure offset roller, specific examples thereof contain an ink jet head, a die coating device (die coater), a blade coating device (blade coater), and the like. The application of the reaction liquid by the reaction liquid applying device may be performed before application of the ink or may be performed after application of the ink as long as mixing (reacting) with the ink on the transfer body is possible. Preferably, the reaction liquid is applied before application of the ink. Applying the reaction liquid before applying the ink makes it possible to suppress bleeding, in which adjacently applied inks are mixed together, or beading, in which ink which landed earlier is attracted to ink which landed later, at the time of forming an ink image by the ink jet method.

Reaction Liquid

The reaction liquid is brought into contact with the ink to increase the viscosity of the ink. Therefore, it is possible for the reaction liquid to contain a component which increases the viscosity of the ink (also referred to as an ink viscosity-increasing component or a reactant). Increase in the viscosity of the ink means that the coloring material, resin, and the like which are the components constituting the ink come into contact with the ink viscosity-increasing component and are chemically reacted or physically adsorbed and due to this, an increase in the viscosity of the ink as a whole is observed. In addition, increasing the viscosity of the ink also contains a case where the viscosity is locally increased due to the aggregation of a part of the components constituting the ink, such as a coloring material. This ink viscosity-increasing component has an effect of at least partially decreasing the fluidity of the ink on the transfer body and suppressing bleeding and beading during ink image formation before liquid removal. As such an ink viscosity-increasing component, it is possible to use known materials such as polyvalent metal ions, organic acids, cationic resins, and porous particles.

Examples of polyvalent metal ions contain divalent metal ions such as $Ca^{2+}$, $Cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $V^{3+}$, and $Al^{3+}$. In order to contain polyvalent metal ions in the reaction liquid, it is possible to use a polyvalent metal salt (which may be a hydrate) formed by combining polyvalent metal ions and anions. Examples of the anions contain inorganic anions such as $Cl^-$, $Br^-$, $I^-$, $ClO^-$, $ClO^{2-}$, $ClO^{3-}$, $ClO^{4-}$, $NO_2^-$, $NO_3^-$, $SO_4^{2-}$, $CO_3^{2-}$, $HCO^{3-}$, $PO_4^{3-}$, $HPO_4^{2-}$, and $H_2PO_4^-$; and organic anions such as $HCOO^-$, $(COO^-)_2$, $COOH(COO^-)$, $CH_3COO^-$, $C_2H_4(COO^-)_2$, $C_6H_5COO^-$, $C_6H_4(CO_0^-)_2$, and $CH_3SO_3^-$. In a case where polyvalent metal ions are used as the ink viscosity-increasing component, the content (mass %) in terms of polyvalent metal salt in the reaction liquid is preferably 1.00 mass % or more and 10.00 mass % or less based on the total mass of the reaction liquid.

A reaction liquid containing an organic acid converts an anionic group of a component present in the ink into an acid form by having a buffering ability in the acidic region (pH less than 7.0, and preferably pH 2.0 to 5.0) to aggregate the ink. Examples of organic acids contain monocarboxylic acids such as formic acid, acetic acid, propionic acid, butyric acid, benzoic acid, glycolic acid, lactic acid, salicylic acid, pyrrolecarboxylic acid, furancarboxylic acid, picolinic acid, nicotinic acid, thiophenecarboxylic acid, levulinic acid, coumaric acid, and salts thereof; dicarboxylic acids such as oxalic acid, malonic acid, succinic acid, glutaric acid, adipic acid, maleic acid, fumaric acid, itaconic acid, sebacic acid, phthalic acid, malic acid, tartaric acid, and salts or hydrogen salts thereof; tricarboxylic acids such as citric acid and trimellitic acid and salts and hydrogen salts thereof; tetracarboxylic acids such as pyromellitic acid and salts and hydrogen salts thereof, and the like.

Examples of cationic resins contain a resin having a structure of a primary to tertiary amine, a resin having a structure of a quaternary ammonium salt, and the like. Specific examples thereof contain resins having structures such as vinylamine, allylamine, vinylimidazole, vinylpyridine, dimethylaminoethyl methacrylate, ethyleneimine, guanidine, and the like. In order to increase the solubility in the reaction liquid, it is also possible to use a cationic resin and an acidic compound in combination, or to carry out a quaternary treatment with a cationic resin. In a case of using a cationic resin as the ink viscosity-increasing component, the content (mass %) of the cationic resin in the reaction liquid is preferably 1.00 mass % or more and 10.00 mass % or less based on the total mass of the reaction liquid.

It is possible for the reaction liquid to contain an appropriate amount of water or a low volatility organic solvent. The water used in such a case is preferably water deionized by ion exchange or the like. In addition, the organic solvent which is able to be used in the reaction liquid applied to the present invention is not particularly limited, and it is possible to use known organic solvents.

In addition, it is possible to use the reaction liquid after suitably adjusting the surface tension and the viscosity by adding a surfactant or a viscosity adjusting agent thereto. The material to be used is not particularly limited as long as it is possible to be present with the ink viscosity-increasing component. Specific examples of the surfactant contain acetylene glycol ethylene oxide adduct ("Acetylenol E 100" (trade name), manufactured by Kawaken Fine Chemicals Co., Ltd.), perfluoroalkyl ethylene oxide adduct ("Megafac F444" (trade name), manufactured by DIC Corporation), and the like.

Ink Applying Device

The transfer type ink jet recording apparatus described above has an ink applying device for applying ink onto a transfer body. An ink image containing the liquid component and the coloring material is formed by mixing the reaction liquid and the ink, and then the liquid component is removed from the ink image by the liquid removing device.

An ink jet head (a recording head for the ink jet method) is used as an ink applying device for applying ink. Examples of the ink jet head contain a form in which an electrothermal transducer causes film boiling in the ink and forms bubbles to discharge ink, a form in which ink is discharged by an electro-mechanical transducer, a form in which ink is discharged using static electricity, and the like. In the present invention, it is possible to use a known ink jet head. Among the above, ink jet heads utilizing an electrothermal transducer are preferably used particularly from the viewpoint of performing high-speed and high-density printing. Drawing is performed by receiving image signals and applying necessary amounts of ink to each position.

In the present embodiment, the ink jet head is a full line head (full line type recording head) extended in the Y direction, and the nozzles are arranged in a range covering the width of the maximum size of the usable image recording region of the recording medium. The ink jet head has an ink discharge surface whose nozzle is open on the lower surface (transfer body side) of the ink jet head, and the ink discharge surface opposes the surface of the transfer body via a minute gap (approximately several millimeters).

It is possible to express the ink application amount using the density value of the image data, the ink thickness, or the like; however, in the present invention, the ink application amount ($g/m^2$) is defined as the average value obtained by multiplying the mass of each ink dot by the number of ink dots and dividing by the printing area. Here, from the viewpoint of removing the liquid component in the ink, the maximum ink application amount in the image region indicates the ink application amount applied in an area of at least 5 $mm^2$ or more in the region used as the information of the ink receiving medium.

The transfer type ink jet recording apparatus described above may have a plurality of ink jet heads in order to apply inks of each color onto a transfer body. For example, in a case of forming respective color images using yellow ink, magenta ink, cyan ink, and black ink, the transfer type ink jet recording apparatus has four ink jet heads which respectively discharge the four kinds of inks described above onto a transfer body. The heads are arranged to line up in the X direction.

In addition, the ink applying device may contain an ink jet head which discharges substantially transparent clear ink which does not contain a coloring material, or even if contained, which has the coloring material at an extremely low ratio. It is possible to use the clear ink to form an ink image together with a reaction liquid and color inks. For example, it is possible to use the clear ink to improve the glossiness of the image. It is preferable to appropriately adjust the resin component to be blended and further control the discharge position of the clear ink, such that the image after transfer has a glossy feel. Since it is desirable that the clear ink is further to the surface layer side than the color ink in the final recorded matter, in the transfer body type ink jet recording apparatus, it is preferable to apply the clear ink on the transfer body before the color ink. In such a case, in the moving direction of the transfer body opposing the ink applying device, it is possible to arrange the ink jet head for clear ink on the upstream side of the ink jet head for color ink.

In addition, as well as the glossiness, it is also possible to use the clear ink for improving transferability of an ink image from a transfer body to a recording medium. For example, by containing more components which exhibit more adhesiveness than a color ink in a clear ink and applying the clear ink to a color ink, it is possible to use the clear ink as a transferability improving liquid which improves the transferability of an ink image. Specifically, in the moving direction of the transfer body opposing the ink applying device, an ink jet head for clear ink for improving transferability is arranged on the downstream side of the ink jet head for color ink. After applying the color ink to the transfer body, clear ink is applied to the transfer body after color ink application, such that there is clear ink on the outermost surface of the ink image. In the transfer of the ink image to the recording medium in the transfer portion, the clear ink on the surface of the ink image adheres to the recording medium with a certain degree of adhesive force. This makes it easier to move the ink image after liquid removal to the recording medium.

Ink

A description will be given of each component of the ink applied to the present invention.

Coloring Material

As the coloring material contained in the ink, it is possible to use pigments and dyes. The content of the coloring material in the ink is preferably 0.5 mass % or more and 15.0 mass % or less based on the total mass of the ink, and more preferably 1.0 mass % or more and 10.0 mass % or less.

The type of pigment able to be used as a coloring material is not particularly limited. Specific examples of pigments contain inorganic pigments such as carbon black and titanium oxide; organic pigments such as azo-based pigments, phthalocyanine-based pigments, quinacridone-based pigments, isoindolinone-based pigments, imidazolone-based pigments, diketopyrrolopyrrole-based pigments, dioxazine-based pigments, and the like. It is possible for these pigments to be used alone or in a combination of two or more types, as necessary. The dispersion method of the pigment is not particularly limited. For example, it is also possible to use a resin-dispersed pigment dispersed with a resin dispersant, a self-dispersible pigment in which a hydrophilic group such as an anionic group is bound directly or via another atomic group to the particle surface of a pigment, or the like. Naturally, it is also possible to use pigments with different dispersing methods in combination.

As the resin dispersant for dispersing the pigment, it is possible to use a known resin dispersant used for an ink jet aqueous ink. Among the above, it is preferable to use an acrylic water-soluble resin dispersant having both a hydrophilic unit and a hydrophobic unit in the molecular chain. Examples of the form of the resin contain a block copolymer, a random copolymer, a graft copolymer, combinations thereof, and the like.

The resin dispersant in the ink may be in a state of being dissolved in the liquid medium or in a state of being dispersed as resin particles in the liquid medium. In the present invention, that the resin is water-soluble means that in a case of being neutralized with an alkali value equivalent to the acid value of the resin, particles for which it is possible to measure the particle diameter by a dynamic light scattering method are not formed.

It is possible to form a hydrophilic unit (a unit having a hydrophilic group such as an anionic group), for example, by polymerizing a monomer having a hydrophilic group. Specific examples of the monomer having a hydrophilic group contain acidic monomers having an anionic group such as (meth)acrylic acid or maleic acid, anionic monomers such as anhydrides and salts of these acidic monomers, and the like. Examples of the cations forming the salt of the acidic monomer contain ions such as lithium, sodium, potassium, ammonium, organic ammonium, and the like.

It is possible to form a hydrophobic unit (a unit having no hydrophilicity such as an anionic group), for example, by polymerizing a monomer having a hydrophobic group. Specific examples of monomers having a hydrophobic group contain monomers having an aromatic ring such as styrene, α-methylstyrene, and benzyl (meth)acrylate; monomers having an aliphatic group (that is, (meth)acrylic ester-based monomers) such as ethyl (meth)acrylate, methyl (meth) acrylate, and butyl (meth)acrylate.

The acid value of the resin dispersant is preferably 50 mg KOH/g or more and 550 mg KOH/g or less, and more preferably 100 mg KOH/g or more and 250 mg KOH/g or less. In addition, the weight average molecular weight of the resin dispersant is preferably 1,000 or more and 50,000 or less. The content (mass %) of the pigment is preferably 0.3 times or more and 10.0 times or less with respect to the content of the resin dispersant in terms of the mass ratio (pigment/resin dispersant).

As the self-dispersion pigment, it is possible to use a pigment in which an anionic group such as a carboxylic acid group, a sulfonic acid group, or a phosphonic acid group is bonded directly or through another atomic group (—R—) to the particle surface of the pigment. The anionic group may be either an acid form or a salt form and, in the case of a salt form, may be either in a partially dissociated state or in a fully dissociated state. Examples of the cation forming the counter ion in the case where the anionic group is in the salt form contain alkali metal cations; ammonium; organic ammonium and the like. In addition, specific examples of the other atomic group (—R—) contain a linear or branched alkylene group having 1 to 12 carbon atoms, an arylene group such as a phenylene group or a naphthylene group, an amide group, a sulfonyl group, an amino group, a carbonyl group, an ester group, an ether group, and the like. In addition, the other atomic group may also be a group in which these groups are combined.

The type of dye which is able to be used as a coloring material is not particularly limited, but it is preferable to use a dye having an anionic group. Specific examples of dyes contain azo-based dyes, triphenylmethane-based dyes, (aza) phthalocyanine-based dyes, xanthene-based dyes, anthrapyridone-based dyes, and the like. It is possible to use one type or two or more types of these dyes as required.

Resin Particles

It is possible to use the ink applied to the present invention containing various types of particles without a coloring material. Among these, the resin particles may be effective in improving image quality and fixability, which is preferable. The material of the resin particles which are able to be used in the present invention is not particularly limited, and it is possible to appropriately use known resins. Specific examples thereof contain homopolymers such as polyolefin, polystyrene, polyurethane, polyester, polyether, polyurea, polyamide, polyvinyl alcohol, poly(meth)acrylic acid and salts thereof, alkyl poly(meth)acrylate, and polydiene, or copolymers obtained by polymerization of a plurality of monomers for producing these homopolymerized products. The weight average molecular weight (Mw) of the resin is preferably in the range of 1,000 or more and 2,000,000 or less. The volume average particle diameter of the resin particles measured by the dynamic light scattering method is preferably 10 nm or more and 1,000 nm or less, and more preferably 100 nm or more and 500 nm or less. In addition, the amount of the resin particles in the ink is preferably 1.0 mass % or more and 50.0 mass % or less with respect to the total mass of the ink, and more preferably 2.0 mass % or more and 40.0 mass % or less.

Water and Water-Soluble Organic Solvent

It is possible for the ink used in the present invention to contain water and/or a water-soluble organic solvent as a solvent. As water, it is preferable to use deionized water or ion-exchanged water. As the water-soluble organic solvent, it is possible to use any solvent usable for ink jet ink such as alcohol, (poly) alkylene glycol, glycol ether, nitrogen-containing compounds, and sulfur-containing compounds. It is possible to use one type or two or more types of the above. The content (mass %) of water in the ink is preferably 50.0 mass % or more and 95.0 mass % or less based on the total mass of the ink. In addition, the content (mass %) of the water-soluble organic solvent in the ink is preferably 3.0 mass % or more and 50.0 mass % or less based on the total mass of the ink.

Other Additives

In addition to the components described above, the ink used in the present invention may contain various additives such as an antifoam agent, a surfactant, a pH adjuster, a viscosity modifier, a rust inhibitor, an antiseptic, a fungicide, an antioxidant, an anti-reduction agent, and a water-soluble resin, as necessary.

Liquid Removing Device

A liquid removing device which is the liquid absorbing unit according to the present invention absorbs the liquid component in an ink image by bringing a liquid absorbing member into contact with an ink image before liquid removal and absorbs and removes at least a part of the liquid component from the ink image. The liquid removing device 105 shown in FIG. 1 has the liquid absorbing member 105*a* and a liquid absorbing pressing member 105*b* which presses the liquid absorbing member 105*a* onto the ink image on the transfer body 101. For example, as shown in FIG. 1, it is possible to set the liquid absorbing member 105*a* and the liquid absorbing pressing member 105*b* such that the liquid absorbing pressing member 105*b* has an arbitrary fixed shape and the liquid absorbing member 105*a* is an endless liquid absorbing sheet. Such a liquid removing device having a belt-shaped liquid absorbing member may have an extending member for extending the liquid absorbing member. In FIG. 1, 105*c* is an extending roller as an extending member.

In the liquid removing device 105 shown in FIG. 1, by the liquid absorbing pressing member 105*b* pressing the liquid absorbing member 105*a* into contact with the ink image, the liquid component contained in the ink image is absorbed by the liquid absorbing member 105*a* and the liquid component is reduced. As a method of reducing the liquid component in the ink image, in addition to the present method described above of bringing the liquid absorbing member into contact with the ink image, various other methods used in the related art such as a method using heating, a method of blowing low humidity air, or a method of reducing pressure may be combined. In addition, these methods may be applied to the ink image after liquid removal in which the liquid component is reduced to further reduce the liquid component. A detailed description will be given below of various conditions and configurations in the liquid removing device.

Liquid Absorbing Member

The liquid absorbing member according to the present invention is preferably a liquid absorbing member having a porous body. In this case, the contact surface of the liquid absorbing member with the ink image is set as the first surface, and the porous body is arranged on the first surface. The liquid absorbing member having such a porous body moves in conjunction with the movement of the transfer body and, preferably has a shape which, after coming into contact with the ink image before liquid removal, is able to circulate and re-contact another ink image before liquid removal in a predetermined period so as to be able to carry out liquid absorption. Examples of such shapes contain an endless belt shape and a drum shape.

Porous Body

The porous body is preferably a porous body in which the average pore diameter on the first surface side is smaller than the average pore diameter on a second surface side opposite to the first surface side. In order to suppress the attachment of the coloring material in the ink image to the porous body, the pore diameter of the porous body is preferably small, and the average pore diameter of the porous body on the first surface side is preferably 10 μm or less. In the present invention, the average pore diameter means the average diameter on the surface of the first surface or the second surface, and it is possible to carry out measurement by a mercury intrusion method, a nitrogen adsorption method, SEM image observation, or the like. In addition, in order to have uniformly high air permeability, the thickness of the porous body is preferably small. It is possible to indicate the air permeability by the Gurley value defined in JIS P 8117, and the Gurley value is preferably equal to or shorter than 10 seconds. However, when the porous body is thinned, since it may not be possible to sufficiently secure the capacity necessary for absorbing the liquid component, the porous body is preferably formed with a multilayer configuration. In addition, in the liquid absorbing member, it is sufficient if the layer in contact with the ink image before liquid removal on the transfer body is a porous body, and layers not in contact with the ink image before liquid removal on the transfer body need not be porous bodies.

Next, a description will be given of an embodiment in a case where the porous body has a multilayer configuration. Here, in the description, the layer on the side which comes into contact with the ink image before liquid removal is the first layer, and the layer laminated on the surface opposite to the contact surface with the ink image before liquid removal in the first layer is the second layer. Furthermore, the multilayer configuration is sequentially expressed in the order of lamination from the first layer. In this specification, the first layer may be referred to as an "absorbing layer", and the second and subsequent layers may be referred to as "supporting layers". In addition, in a case where the porous body has a configuration with only one layer, it is possible to form only the first layer.

First Layer

The material of the first layer is not particularly limited, and it is possible to use any of a hydrophilic material having a contact angle with respect to water of less than 90° and a water-repellent material having a contact angle of 90° or more. Examples of the hydrophilic material contain single materials such as cellulose and polyacrylamide, or a composite material thereof. In addition, it is also possible to carry out a hydrophilic treatment on the surface of a porous body formed of a later-described water-repellent material and use this as the hydrophilic material. Examples of the hydrophilic treatment contain methods such as a sputter etching method, irradiation with radiation or $H_2O$ ions, or excimer (ultraviolet) laser light irradiation. In the case of a hydrophilic material, the contact angle with respect to water is more preferably 60° or less. In the case of a hydrophilic material, there is an effect of sucking up liquid, particularly water, by capillary force.

On the other hand, in order to suppress attachment of the coloring material and to improve the cleaning property, the material of the first layer is preferably a water-repellent material having low surface free energy, and more preferably a fluororesin. Specific examples of the fluororesin contain polytetrafluoroethylene (PTFE), polychlorotrifluoroethylene (PCTFE), polyvinylidene fluoride (PVDF), polyvinyl fluoride (PVF), perfluoroalkoxy fluororesin (PFA), tetrafluoroethylene hexafluoropropylene copolymer (FEP), ethylene tetrafluoroethylene copolymer (ETFE), ethylene chlorotrifluoroethylene copolymer (ECTFE), and the like. It is possible to use one type or two or more types of these resins as necessary. In addition, a configuration in which a plurality of films are laminated in the first layer may be adopted. In the case of a water repellent material, there is almost no effect of sucking up the liquid by capillary force and sucking up the liquid may take time when contacting the ink image for the first time. Therefore, a liquid having a contact angle with the first layer of less than 90° is preferably impregnated in the first layer. It is possible to impregnate this liquid into the first layer by coating the liquid from the first surface of the liquid absorbing member. This liquid is preferably prepared by mixing a surfactant and a liquid having a low contact angle with the first layer in water.

The thickness of the first layer is preferably 50 μm or less, and more preferably 30 μm or less. The thickness is a value obtained by measuring the thickness of 10 arbitrary points with a straight type micrometer OMV-25 (trade name, manufactured by Mitutoyo) and calculating the average value thereof.

It is possible to manufacture the first layer by a known method for manufacturing a thin porous film. For example, by forming a resin material into a sheet by a method such as extrusion molding and then drawing the sheet to a predetermined thickness, the first layer can be obtained. In addition, by adding a plasticizer such as paraffin during extrusion molding and removing the plasticizer by heating or the like at the time of drawing, a porous film can be obtained. It is possible to adjust the pore diameter by appropriately adjusting the amount of the plasticizer to be added, the draw ratio, and the like.

Second Layer

The second layer is preferably a layer having air permeability. Such a layer may be a nonwoven fabric of resin fiber or may be a woven fabric. The material of the second layer is not particularly limited; however, the material is preferably a material having a contact angle with the liquid component equal to or lower than that of the first layer, such that the absorbed liquid component does not flow backward toward the first layer side. Specifically, examples thereof contain single materials such as polyolefin (polyethylene (PE), polypropylene (PP), and the like), polyurethane, polyamide such as nylon, polyester (polyethylene terephthalate (PET), and the like), and polysulfone (PSF), composite materials thereof, and the like. In addition, the second layer is preferably a layer having a larger pore diameter than the first layer.

Third Layer

From the viewpoint of rigidity, a nonwoven fabric is preferable as the third and subsequent layers. The same material as the second layer is used as the material of the third and subsequent layers.

Other Members

In addition to the porous body having the laminated structure described above, the liquid absorbing member may have a reinforcing member for reinforcing the side surface of the liquid absorbing member. In addition, the liquid absorbing member may have a bonding member when connecting the longitudinal direction end portions of the elongated sheet-shaped porous body to each other to form a belt-shaped member. As such a material, it is possible to use a non-porous tape material or the like and arrangement is possible at a position or period not in contact with the ink image before liquid removal.

Method of Preparing Porous Body

The method of laminating the first layer and the second layer to form a porous body is not particularly limited. The first layer and the second layer may be overlapped only or may be adhered to each other using a method such as lamination by adhesive agent or lamination by heating. From the viewpoint of air permeability, the layers are preferably adhered to each other by lamination by heating in which each layer is sandwiched by a heated roller and heated while being pressurized. In addition, for example, parts of the first layer or the second layer may be melted by heating to adhere to each other. In addition, a fusing material such as a hot melt powder may be interposed between the first layer and the second layer so that the first layer and the second layer are bonded to each other by heating. In a case of laminating the third and subsequent layers, the layers may be laminated in one batch or may be laminated in order. The laminating order is appropriately selected.

Pretreatment

It is preferable to perform a pretreatment of applying the treatment liquid with respect to the liquid absorbing member by a pretreatment means before bringing a liquid absorbing member having the porous body into contact with the ink image before liquid removal. The treatment liquid preferably contains water and a water-soluble organic solvent. The water is preferably water deionized by ion exchange or the like. The type of the water-soluble organic solvent is not particularly limited, and it is possible to use any known organic solvents such as ethanol and isopropyl alcohol. The method of applying the treatment liquid is not particularly limited, but immersion and liquid drop deposition are preferable.

Pressurizing Conditions

If the pressure of the liquid absorbing member which is in pressure contact with respect to the ink image before liquid removal on the transfer body is 2.9 $N/cm^2$ (0.3 $kgf/cm^2$) or more, it is possible to carry out solid-liquid separation in the ink image in a shorter time and it is possible to remove the liquid component from the ink image, which is preferable. Here, the pressure of the liquid absorbing member in the present specification indicates the nip pressure between the ink receiving medium and the liquid absorbing member, and surface pressure measurement is performed by a surface pressure distribution measuring device (I-SCAN (trade name), manufactured by Nitta Corp.), and the weight in the pressurized area is divided by the area to calculate the value.

Application Time

The application time of bringing the liquid absorbing member into contact with the ink image before liquid removal is preferably 50 ms (milliseconds) or less in order to further suppress attachment of the coloring material in the ink image to the liquid absorbing member. Here, in this specification, in the surface pressure measurement described above, the application time is calculated by dividing the pressure sensing width in the moving direction of the ink receiving medium by the moving speed of the ink receiving medium. Below, this application time is referred to as a liquid absorbing nip time.

Relationship Between Shapes of Ink Receiving Medium and Liquid Absorbing Member at Contact Start Position A description will be given of the relationship between the shapes of the ink receiving medium and the liquid absorbing member at the contact start position in the present invention using FIG. 8. When the liquid absorbing member 805 is pressed by the liquid absorbing pressing member 803 so that the ink receiving medium 801 and the liquid absorbing member 805 start to contact each other, the contact surface of the liquid absorbing member 805 with the ink receiving medium 801 is set to have a shape having a circle arc shown by a dotted line centered around a circle center 804. In such a case, since the circle center 804 is outside the liquid absorbing member 805 which is the target, the curvature radius R2 in the shape is negative. That is, the shape is a shape having a recess with respect to the ink receiving medium 801.

Here, since R1>0 and R2<0 in FIG. 8, it is possible to prevent convex parts of the ink receiving medium 801 and the liquid absorbing member 805 from coming into contact with each other and a high pressure is not applied at the time of contact between the two, thus, it is possible to suppress smeared images. In addition, since |R1|≤|R2| is satisfied, it is possible to prevent the end portion of the arc of the liquid absorbing member 805 from coming into contact with the ink receiving medium 801 at the start of contact and a high pressure is not applied at the time of contact between the two, thus, it is possible to suppress smeared images. In addition, when |R1|/|R2| is 0.8 or more, since it is possible to greatly reduce the contact pressure between the ink receiving medium 801 and the liquid absorbing member 805, it is possible to further suppress smeared images. |R1|/|R2| is more preferably 0.85 or more, and even more preferably 0.9 or more.

It is possible to obtain a liquid absorbing member shape which satisfies the conditions described above by making the shape of the liquid absorbing pressing member into a desired shape. In addition, the relationship between the curved surfaces when the ink receiving medium and the liquid absorbing member are separated from each other is not particularly limited. As a result of studies by the present inventors and the like, it is understood that the pressure at the start of contact is important in relation to the smeared images, and the pressure after contact until separation has hardly any influence. In this manner, the liquid component is removed, and an ink image after liquid removal in which the liquid component is reduced is formed on the transfer body.

Pressing Member for Transferring

The transfer type ink jet recording apparatus according to the present embodiment is able to have a pressing member for transferring which presses a recording medium onto a transfer body on which an ink image after liquid component removal is formed and which transfers the ink image to the recording medium. In the transfer type ink jet recording apparatus 100 shown in FIG. 1, an ink image after liquid removal on the transfer body 101 is transferred onto the recording medium 108 conveyed by the conveyance device for recording medium 107 by being brought into contact with the recording medium 108 by the pressing member 106 for transferring. In the present invention, since the liquid component contained in the ink image on the transfer body is removed in advance, it is possible to obtain a recorded image in which curling, cockling, and the like are suppressed.

The pressing member is required to have a certain level of structural strength from the viewpoints of the conveyance precision of the recording medium and durability. For the material of the pressing member, metal, ceramics, resin, or the like is preferably used. Among these, in particular, in order to improve the rigidity able to withstand pressurization at the time of transfer and dimensional precision as well as the responsiveness of control by reducing inertia at the time of operation, it is preferable to use aluminum, iron, stainless steel, acetal resin, epoxy resin, polyimide, polyethylene, polyethylene terephthalate, nylon, polyurethane, silica ceramics, and alumina ceramics. In addition, the above may be used in combination.

The pressing time during which the pressing member presses the transfer body in order to transfer the ink image after liquid removal on the transfer body to the recording medium is not particularly limited, but is preferably 5 ms (milliseconds) or more and 100 ms (milliseconds) or less from the point of view of the transfer being satisfactory and the durability of the transfer body not being impaired. The pressing time in the present invention indicates the time during which the recording medium and the transfer body are in contact with each other and is a value which is calculated by carrying out surface pressure measurement using a surface pressure distribution measuring device (I-SCAN (trade name), manufactured by Nitta Corp.) and dividing the conveyance direction length of the pressure region by the conveyance speed.

The pressure with which the pressing member presses the transfer body in order to transfer the ink image after liquid removal on the transfer body to the recording medium is also not particularly limited, but care is taken to perform the transfer satisfactorily, and to not impair the durability of the transfer body. Therefore, the pressure is preferably 9.8 $N/cm^2$ (1 $kg/cm^2$) or more, and 294.2 $N/cm^2$ (30 $kg/cm^2$) or less. Here, the pressure indicates the nip pressure between the recording medium and the transfer body and is a value calculated by measuring the surface pressure using a surface pressure distribution measuring device and dividing the weight in the pressure region by the area.

The temperature when the pressing member presses the transfer body in order to transfer the ink image after liquid removing on the transfer body to the recording medium is also not particularly limited, but it is preferably the glass transition point or higher or the softening point or higher of the resin component contained in the ink. In addition, the heating means is preferably provided with a means capable of heating the ink image after liquid removing on the transfer body, the transfer body, and the recording medium. The shape of the pressing member is not particularly limited, but examples thereof contain a roller shape.

Recording Medium and Conveyance Device for Recording Medium

The recording medium is not particularly limited and it is possible to use any known recording medium. Examples of recording media contain long objects wound in a roll form or a sheet material cut to a predetermined size. Examples of materials contain paper, plastic film, wood board, cardboard, metal film, and the like. In FIG. 1, the conveyance device for recording medium 107 for conveying the recording medium 108 is formed by the recording medium feeding roller 107*a* and the recording medium take-up roller 107*b*, but it is not particularly limited to this configuration as long as the recording medium is able to be conveyed.

Control System

Figure 5:
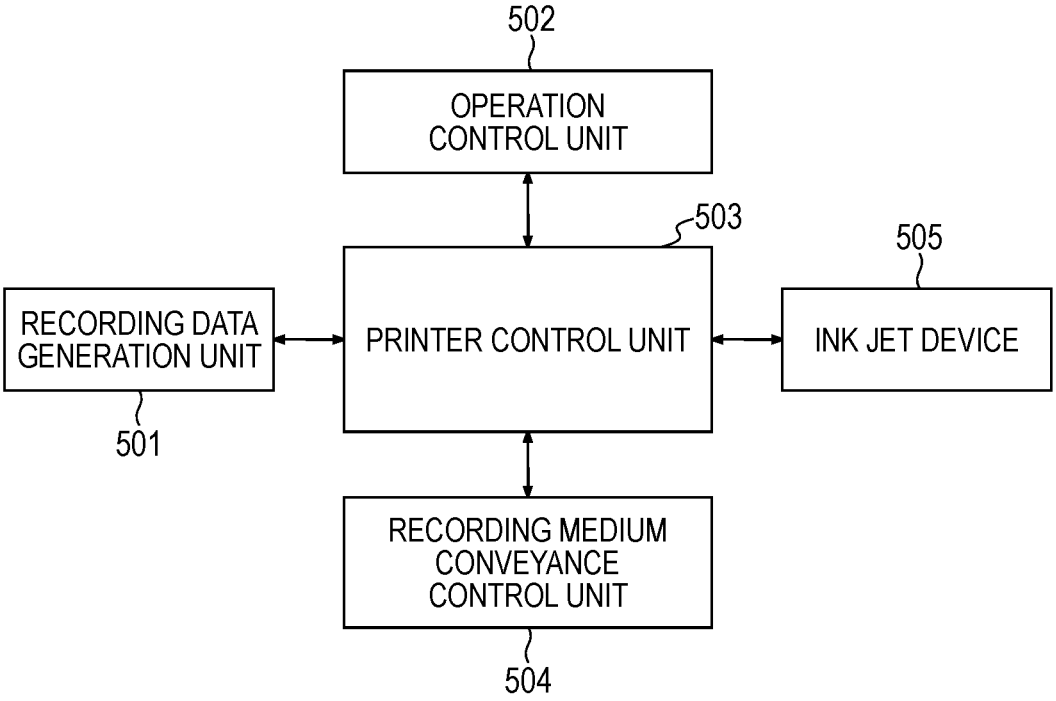
FIG. 5 is a block diagram illustrating a control system of the entire apparatus in the ink jet recording apparatus shown in FIGS. 1, 2, 3, and 4.

The transfer type ink jet recording apparatus according to the present embodiment is able to have a control system for controlling each device. FIG. 5 is a block diagram illustrating the control system of the entire apparatus in the transfer type ink jet recording apparatus 100 shown in FIG. 1. In FIG. 5, 501 is a recording data generation unit such as an external print server, 502 is an operation control unit such as an operation panel, and 503 is a printer control unit for executing a recording process. In addition, 504 is a recording medium conveyance control unit for conveying the recording medium, and 505 is an ink jet device for printing.

Figure 6:
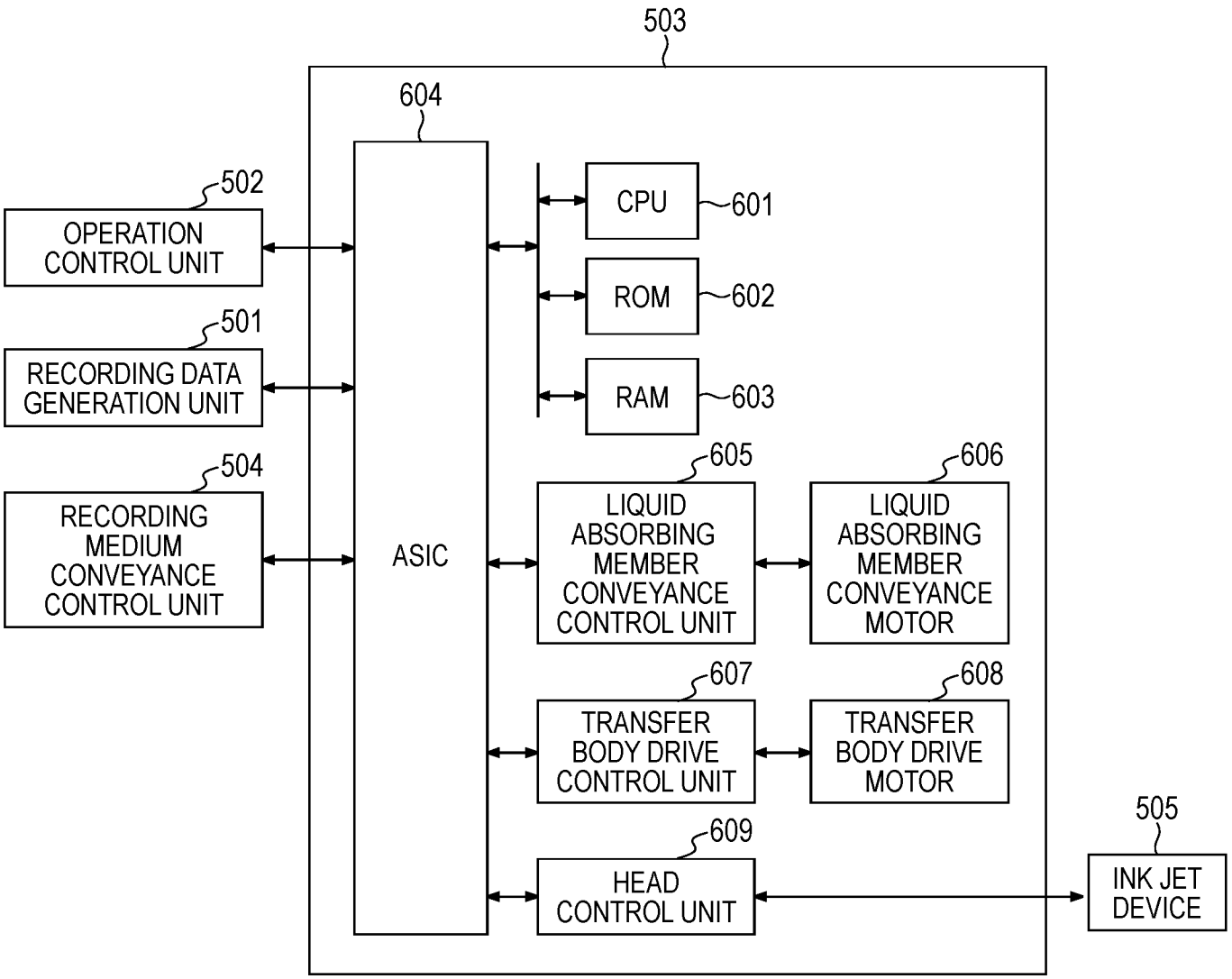
FIG. 6 is a block diagram of a printer control unit in the transfer type ink jet recording apparatus shown in FIGS. 1 and 2.

FIG. 6 is a block diagram of a printer control unit in the transfer type ink jet recording apparatus 100 shown in FIG. 1. 601 is a CPU for controlling the entire printer, 602 is a ROM for storing the control program of the CPU 601, and 603 is a RAM for executing a program. 604 is an application specific integrated circuit (ASIC) incorporating a network controller, a serial IF controller, a controller for generating head data, a motor controller, and the like. 605 is a liquid absorbing member conveyance control unit for driving a liquid absorbing member conveyance motor 606, and is controlled by commands from the ASIC 604 via the serial IF. 607 is a transfer body drive control unit for driving the transfer body drive motor 608, and is similarly controlled by commands from the ASIC 604 via the serial IF. 609 is a head control unit which carries out final discharge data generation, drive voltage generation of the ink jet device 505, and the like.

Transfer Type Ink Jet Recording Apparatus when Curvature Radius R1 of Ink Receiving Medium is Negative at Contact Start Position Between Liquid Absorbing Member and Ink Image FIG. 2 is a schematic diagram illustrating one example of a schematic configuration of a transfer type ink jet recording apparatus according to the present embodiment, in which the curvature radius R1 of the ink receiving medium is negative at the contact start position between the liquid absorbing member and the ink image. A transfer type ink jet recording apparatus 200 shown in FIG. 2 has the same configuration as the transfer type ink jet recording apparatus 100 shown in FIG. 1 with the exception that the ink image is formed on a transfer body 201 supported and moved by support members 202*a*, 202*b*, and 202*c*.

Accordingly, a reaction liquid applying device 203, which has a reaction liquid storing unit 203*a* and reaction liquid applying units 203*b* and 203*c* and which applies the reaction liquid onto the transfer body 201, an ink applying device 204, which applies ink, a liquid removing device 205, which has a liquid absorbing member 205*a*, a liquid absorbing pressing member 205*b*, and an extending roller 205*c* and which absorbs and removes liquid components contained in the ink image, a pressing member 206 for transferring, a transfer apparatus 207, which has a recording medium feeding roller 207*a*, and a recording medium take-up roller 207*b* and which transfers the ink image after liquid removal to a recording medium 208, and a cleaning member 209 for a transfer body have the same configuration as in the transfer type ink jet recording apparatus 100 and description thereof will be omitted.

Figure 9:
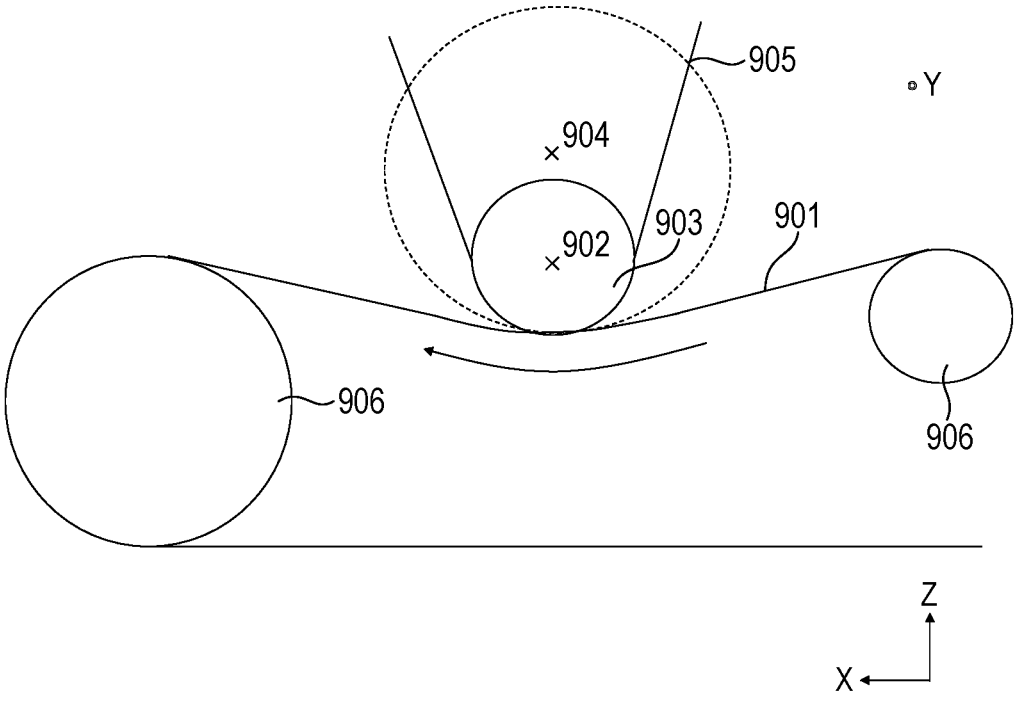
FIG. 9 is a schematic diagram illustrating a state when an ink receiving medium and a liquid absorbing member are in contact in the transfer type ink jet recording apparatus shown in FIG. 2.

In the transfer type ink jet recording apparatus 200, the transfer body 201 has a belt shape, and the shape of the transfer body 201 when making contact with the liquid absorbing member 205*a* is formed using the roller-shaped support members 202*a*, 202*b*, and 202*c*. FIG. 9 shows a state when the transfer body and the liquid absorbing member come into contact with each other in the transfer type ink jet recording apparatus shown in FIG. 2.

In FIG. 9, a transfer body 901 is supported by a support member 906. A liquid absorbing member 905 is pressed against the ink image on the transfer body 901 by the liquid absorbing pressing member 903. At this time, the shape of the contact surface of the transfer body 901 at the time of starting contact with the liquid absorbing member 905 is an arc of a circle centering on a circle center 904 and has a circle center 904 outside the transfer body 901 which is the target. That is, the shape is concave with respect to the liquid absorbing member 905, and the curvature radius R1 is negative. On the other hand, the shape of the contact surface of the liquid absorbing member 905 is an arc of a circle centering on a circle center 902 and the circle center 902 is inside the liquid absorbing member 905 which is the target. That is, the shape is convex with respect to the transfer body 901, and the curvature radius R2 is positive.

Here, since R1<0 and R2>0 in FIG. 9, it is possible to prevent convex parts of the transfer body 901 and the liquid absorbing member 905 from coming into contact with each other and a high pressure is not applied at the time of contact between the two, thus, it is possible to suppress smeared images. In addition, since $|R1| \geq |R2|$ is satisfied, it is possible to prevent the end portion of the arc of the liquid absorbing member 905 from coming into contact with the transfer body 901 at the start of contact and a high pressure is not applied at the time of contact between the two, thus, it is possible to suppress smeared images. In addition, $|R2|/|R1|$ being 0.8 or more makes it possible to greatly decrease the contact pressure between the transfer body 901 and the liquid absorbing member 905, thus, it is possible to further suppress smeared images. $|R2|/|R1|$ is more preferably 0.85 or more, and even more preferably 0.9 or more.

It is possible to achieve a shape of the liquid absorbing member which satisfies the conditions described above by making the shape of the liquid absorbing pressing member into a desired shape. In addition, the relationship between the curved surfaces when the ink receiving medium and the liquid absorbing member are separated from each other is not particularly limited. As a result of studies by the present inventors and the like, it is understood that, in relation to the smeared images, the pressure at the start of contact is important and the pressure after contact until separation has hardly any influence.

Figure 3:
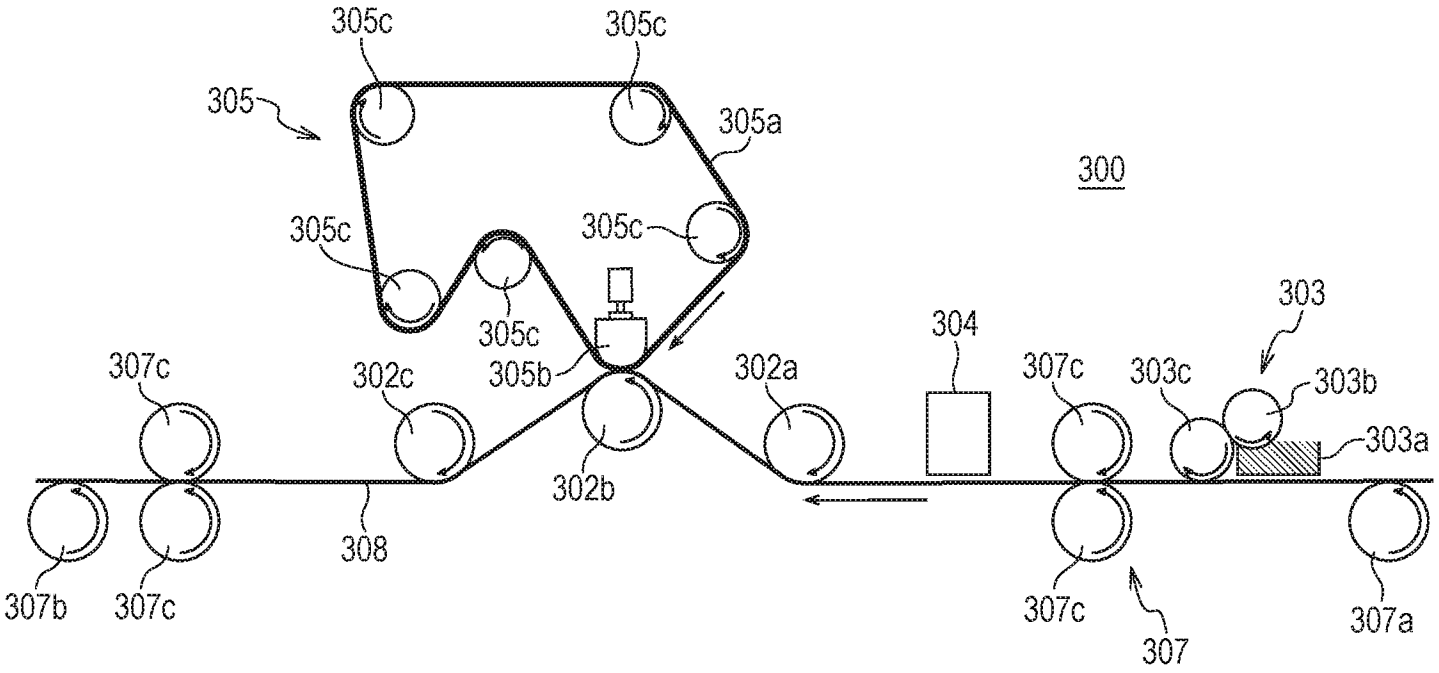
FIG. 3 is a schematic diagram illustrating one example of a configuration of a direct drawing type ink jet recording apparatus in a case where a curvature radius R1 of an ink receiving medium at a contact start position between a liquid absorbing member and an ink image is positive in one embodiment of the present invention.

Direct Drawing Type Ink Jet Recording Apparatus when Curvature Radius R1 of Ink Receiving Medium is Positive at Contact Start Position Between Liquid Absorbing Member and Ink Image Examples of other embodiments of the present invention contain a direct drawing type ink jet recording apparatus. In the direct drawing type ink jet recording apparatus, the ink receiving medium is a recording medium on which an image is to be formed. FIG. 3 is a schematic diagram illustrating one example of a schematic configuration of a direct drawing type ink jet recording apparatus according to the present embodiment in which the curvature radius R1 of the ink receiving medium is positive at the contact start position between the liquid absorbing member and the ink image. A direct drawing type ink jet recording apparatus 300 shown in FIG. 3 has the same configuration as that of the transfer type ink jet recording apparatus 100 with the exception that, in comparison with the transfer type ink jet recording apparatus 100 described above, the configuration does not have the transfer body 101, the support member 102, and the cleaning member 109 for a transfer body, and image forming is carried out on a recording medium 308.

Accordingly, since the reaction liquid applying device 303, which has the reaction liquid storing unit 303*a* and the reaction liquid applying units 303*b* and 303*c* and which applies the reaction liquid to the recording medium 308, and an ink applying device 304 for applying ink to the recording medium 308 have the same configuration as that of the transfer type ink jet recording apparatus 100, description thereof will be omitted. Description will also be similarly omitted of a liquid removing device 305 which has a liquid absorbing member 305*a*, a liquid absorbing pressing member 305*b*, and an extending roller 305*c* and which absorbs and removes the liquid component contained in the ink image.

In the direct drawing type ink jet recording apparatus 300 according to the present embodiment, the shape of the recording medium 308 in contact with the liquid absorbing member 305*a* is configured using the roller-shaped support members 302*a*, 302*b*, and 302*c*. The relationship between the shapes of the recording medium 308 and the liquid absorbing member 305*a* at the contact start position is the same as the case of the transfer type ink jet recording apparatus in the case where the curvature radius R1 is positive as described above.

Conveyance Device for Recording Medium

In the direct drawing type ink jet recording apparatus according to the present embodiment, the conveyance device for recording medium is not particularly limited, and it is possible to use a conveyance apparatus used in a known direct drawing type ink jet recording apparatus. As shown in FIG. 3, examples thereof contain a conveyance device for recording medium 307 having a recording medium feeding roller 307*a*, a recording medium take-up roller 307*b*, and a recording medium conveyance roller 307*c*.

Control System

The direct drawing type ink jet recording apparatus according to the present embodiment has a control system for controlling each device. A block diagram illustrating the control system of the whole apparatus in the direct drawing type ink jet recording apparatus shown in FIG. 3 is as shown in FIG. 5, similar to the transfer type ink jet recording apparatus shown in FIG. 1.

Figure 7:
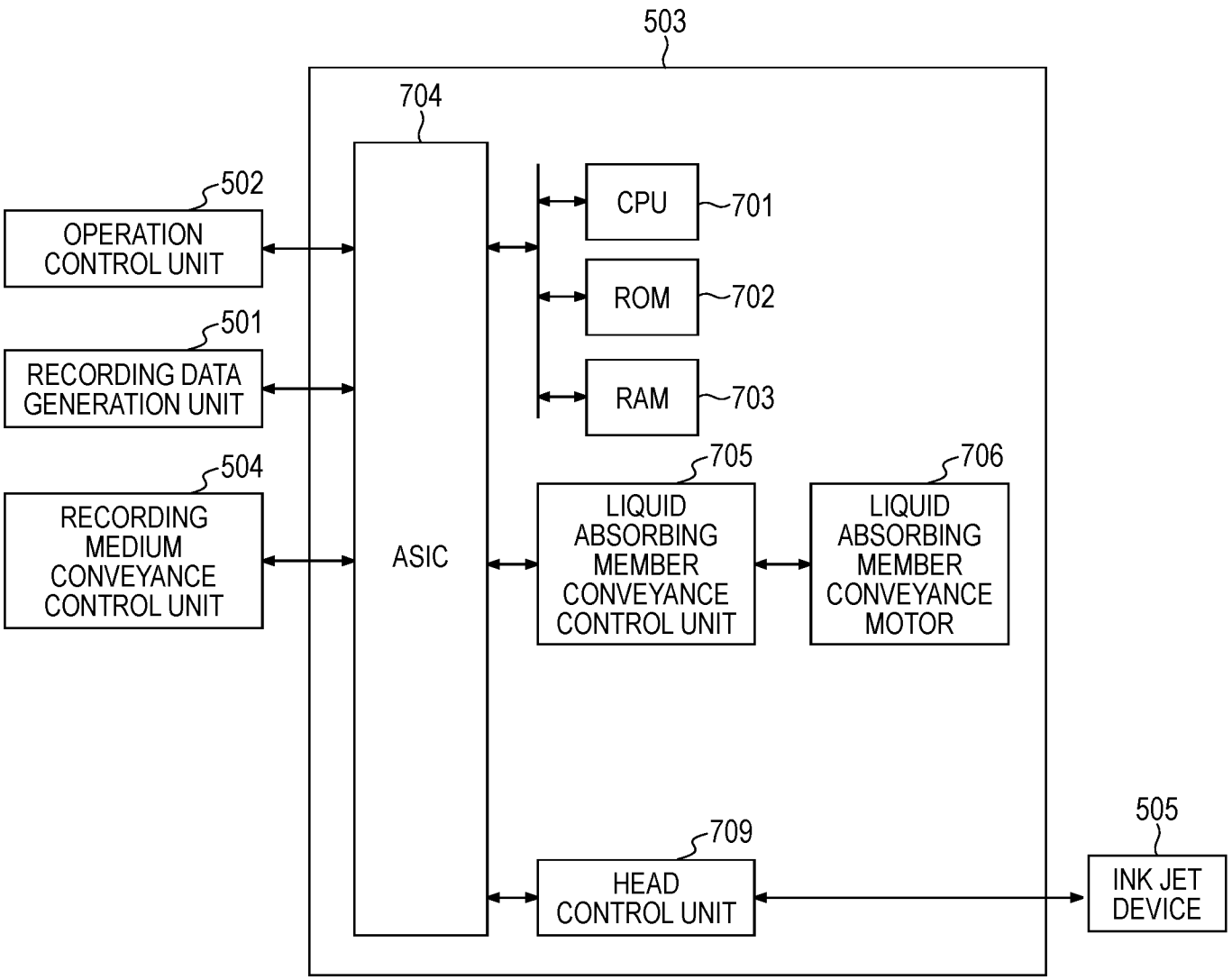
FIG. 7 is a block diagram of a printer control unit in the direct drawing type ink jet recording apparatus shown in FIGS. 3 and 4.

FIG. 7 is a block diagram of the printer control unit in the direct drawing type ink jet recording apparatus of FIG. 3. FIG. 7 is the same as the block diagram of the printer control unit in the transfer type ink jet recording apparatus in FIG. 6 except for not having the transfer body drive control unit 607 and the transfer body drive motor 608.

That is, 701 is a CPU for controlling the entire printer, 702 is a ROM for storing the control program of the CPU, and 703 is a RAM for executing a program. 704 is an ASIC incorporating a network controller, a serial IF controller, a controller for generating head data, a motor controller, and the like. 705 is a liquid absorbing member conveyance control unit for driving a liquid absorbing member conveyance motor 706, and is controlled by commands from the ASIC 704 via the serial IF. 709 is a head control unit and performs final discharge data generation, drive voltage generation of the ink jet device 505, and the like.

Figure 4:
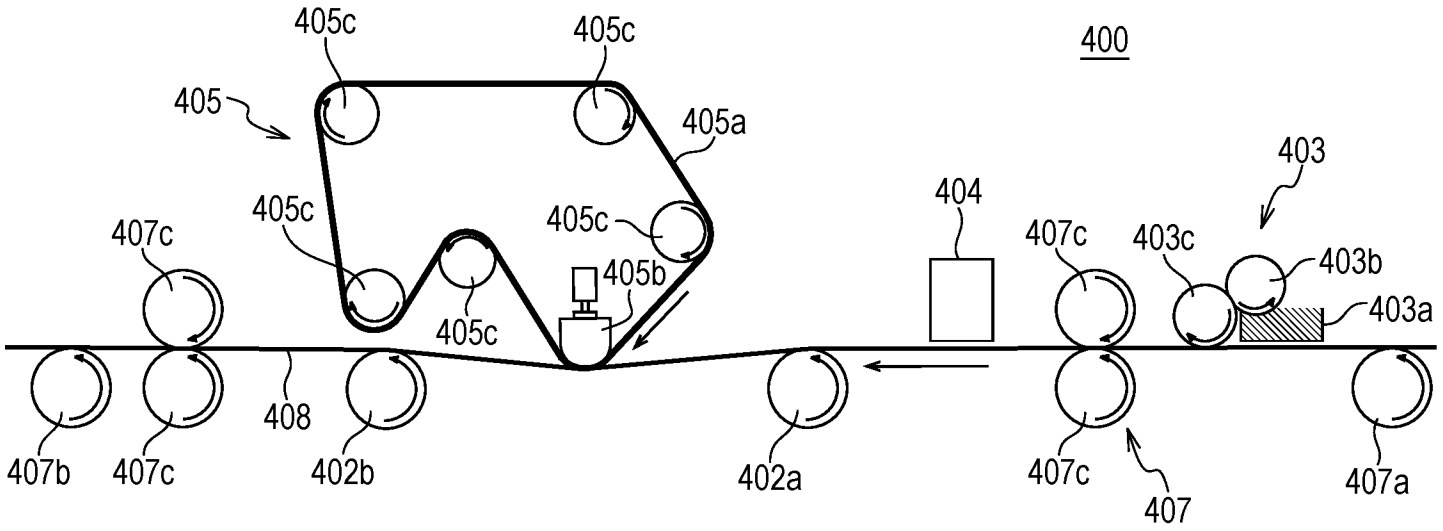
FIG. 4 is a schematic diagram illustrating one example of a configuration of a direct drawing type ink jet recording apparatus in a case where a curvature radius R1 of an ink receiving medium at a contact start position between a liquid absorbing member and an ink image is negative in one embodiment of the present invention.

Direct Drawing Type Ink Jet Recording Apparatus when Curvature Radius R1 of Ink Receiving Medium is Negative at Contact Start Position Between Liquid Absorbing Member and Ink Image FIG. 4 is a schematic diagram illustrating one example of a schematic configuration of a direct drawing type ink jet recording apparatus according to the present embodiment in which the curvature radius R1 of the ink receiving medium is negative at the contact start position between the liquid absorbing member and the ink image. In comparison with the direct drawing type ink jet recording apparatus 300 in the case where the curvature radius R1 is positive as described above, a direct drawing type ink jet recording apparatus 400 shown in FIG. 4 has the same overall configuration except for the contact portion between a liquid absorbing member 405*a* and a recording medium 408.

Accordingly, since a reaction liquid applying device 403 which has a reaction liquid storing unit 403*a* and reaction liquid applying units 403*b* and 403*c* and which applies the reaction liquid to the recording medium 408, and an ink applying device 404 for applying ink to the recording medium 408 have the same structure as that of the transfer type ink jet recording apparatus 300, description thereof will be omitted. Description will also be similarly omitted for a liquid removing device 405 which has the liquid absorbing member 405*a*, a liquid absorbing pressing member 405*b*, and an extending roller 405*c* and which absorbs and removes the liquid component contained in the ink image. In addition, description will also be similarly omitted for a conveyance device for recording medium 407 which has a recording medium feeding roller 407*a*, a recording medium take-up roller 407*b*, and a recording medium conveyance roller 407*c*.

In the direct drawing type ink jet recording apparatus 400 according to the present embodiment, the shape of the recording medium 408 in contact with the liquid absorbing member 405*a* is configured using the roller-shaped support members 402*a* and 402*b*. The relationship between the shapes of the recording medium 408 and the liquid absorbing member 405*a* at the contact start position is the same as the case of the transfer type ink jet recording apparatus in the case where the curvature radius R1 is negative as described above.

Control System

A block diagram illustrating the control system of the whole apparatus in the direct drawing type ink jet recording apparatus shown in FIG. 4 is as shown in FIG. 5, similar to the transfer type ink jet recording apparatus shown in FIG. 1. In addition, the block diagram of the printer control unit in the direct drawing type ink jet recording apparatus shown in FIG. 4 is equivalent to that of the direct drawing type ink jet recording apparatus shown in FIG. 3.

EXAMPLES

A more detailed description will be given below of the present embodiment using Examples and Comparative Examples. As long as the gist of the present invention is not exceeded, the present invention is not limited at all by the following Examples. In the description of the following Examples, unless otherwise specified, "parts" are on a mass basis.

Preparation of Reaction Liquid

The reaction liquid was prepared by mixing and thoroughly stirring the components of the following composition, then filtering under pressure with a microfilter (manufactured by Fuji Film Co., Ltd.) having a pore diameter of 3.0 μm.

Malic acid 48.0 parts
Potassium hydroxide 2.0 parts
Glycerin 10.0 parts
Surfactant (FS 3100 (trade name, manufactured by DIC Corporation)) 7.0 parts
Pure water 63.0 parts Preparation of Pigment Dispersion 10 parts of carbon black (product name: Monarch 1100, manufactured by Cabot Corp.), 15 parts of a pigment dispersant aqueous solution (styrene-acrylate ethyl-acrylate copolymer, acid value: 150, weight average molecular weight: 8,000, solid content 20 mass %, neutralized with potassium hydroxide), and 75 parts of pure water were mixed. This mixture was charged in a batch type vertical sand mill (manufactured by Aimex Corp.) and 200 parts of zirconia beads having a diameter of 0.3 mm were filled therein and dispersed for 5 hours while cooling with water. This dispersion liquid was put in a centrifuge to remove coarse particles to obtain a pigment dispersion having a pigment concentration of approximately 10 mass %.

Preparation of Resin Fine Particle Dispersion 18 parts of butyl methacrylate, 2 parts of 2,2'-azobis-(2-methylbutyronitrile), and 2 parts of n-hexadecane were mixed and stirred for 0.5 hours. This mixed solution was added dropwise to 78 parts of a 6 mass % aqueous solution of NIKKOL BC 15 (trade name, manufactured by Nikko Chemicals Co., Ltd.) as an emulsifier and stirred for 0.5 hours. Next, the mixed solution was irradiated with ultrasonic waves by an ultrasonic irradiator for 3 hours. Subsequently, a polymerization reaction was carried out at 80° C. for 4 hours in a nitrogen atmosphere, the resultant was cooled to normal temperature, then filtration was carried out to obtain a resin fine particle dispersion having a resin content of approximately 20 mass %. The mass average molecular weight of the resin fine particles was approximately 1,000 to 2,000,000 and the dispersed particle diameter was approximately 100 to 500 nm.

Preparation of Ink

The pigment dispersion and the resin fine particle dispersion described above were mixed with each of the following components and thoroughly stirred, then filtered under pressure with a microfilter (manufactured by Fuji Film Co., Ltd.) having a pore diameter of 3.0 μm to prepare an ink.

Pigment dispersion (pigment concentration: approximately 10 mass %) 20.0 parts

Resin fine particle dispersion (resin content: approximately 20 mass %) 50.0 parts Glycerin 5.0 parts Diethylene glycol 7.0 parts L31 (trade name, manufactured by ADEKA Corporation) 3.0 parts Pure water 15.0 parts Production of Transfer Body Silicone rubber KEI 12 (trade name, manufactured by Shin-Etsu Chemical Co., Ltd.) having a rubber hardness of 40° was laminated on the surface of a transparent PET film with a pressure-sensitive adhesive. A hydrophilic treatment was performed on the surface of a layer formed of silicone rubber using an equilibrium plate type atmospheric pressure plasma processing apparatus APT-203 (trade name, manufactured by Sekisui Chemical Co., Ltd.) under the following conditions to produce a transfer body.

Gas used: air; 1000 cc/min $N_2$; 6000 cc/min

Input voltage: 230 V

Processing speed: 20 sec/cm$^2$

Ink Jet Recording Apparatus and Image Formation

Image formation was performed using the transfer type or direct drawing type ink jet recording apparatuses shown in FIG. 1 to FIG. 4. As the transfer bodies 101 and 201, the transfer body produced by the above method was used. The transfer body 101 was fixed on the cylindrical support member 102 using an adhesive. In addition, the transfer body 201 was fixed on the belt using an adhesive and was conveyed in the apparatus using the roller-shaped support members 202*a*, 202*b*, and 202*c*. Illustration of the belt is omitted for simplicity of explanation. Aurora coated paper (trade name, manufactured by Nippon Paper Industries Co., Ltd., basis weight 127.9 g/m$^2$) was used as the recording media 108, 208, 308, and 408. The temperatures of the transfer bodies 101 and 201, and the recording media 308 and 408 were 60° C.

For the reaction liquid applying devices 103, 203, 303, and 403, a gravure offset method was used. For the gravure rollers 103*b*, 203*b*, 303*b*, and 403*b* which are the reaction liquid applying units, rollers having a core of SUS coated with a ceramic layer were used, and cells were engraved at a pitch of 1,200 lines on the surface of the ceramic layer. First, the reaction liquid described above was filled in a cell, and the reaction liquid was transferred to offset rollers 103*c*, 203*c*, 303*c*, and 403*c* as reaction liquid applying units which come into contact with the gravure roller. For the offset roller, a roller in which a rubber layer of ethylene-propylene-diene rubber (EPDM) was formed on the surface on the core of SUS was used. The reaction liquid was uniformly applied from the offset roller onto the transfer body or the recording medium.

Thereafter, using the ink jet heads as the ink applying devices 104, 204, 304, and 404, the ink described above was discharged to form an ink image with a recording dot resolution of 1200 dpi. As the ink jet head, a line head type head was used in which devices of a type which discharge ink by an on-demand method using an electrothermal transducer were arranged in a line shape which is substantially parallel to the conveyance direction of the ink receiving medium. The ink application amount was 20 g/cm$^2$.

Regarding the liquid removing device (liquid absorbing devices) 105, 205, 305, and 405, as the liquid absorbing members 105*a*, 205*a*, 305*a*, and 405*a*, a porous body formed of two layers of a first layer and a second layer was used. As the first layer in contact with the ink image, a polytetrafluoroethylene (PTFE) film having a pore diameter of 0.2 μm and a thickness of 10 μm obtained by extending a resin was used. As the second layer, a nonwoven fabric formed of PET having a pore diameter of 20 μm and a thickness of 190 μm was used. The first layer and the second layer were integrated by lamination by heating and used as liquid absorbing members 105*a*, 205*a*, 305*a*, and 405*a*. The Gurley value defined by JIS P 8117 of the liquid absorbing member was 8 seconds. In addition, the conveyance speed of the liquid absorbing member was 0.6 g/m$^2$ and was adjusted to be a speed equal to the moving speed of the transfer body and the recording medium by the extending rollers 105*c*, 205*c*, 305*c*, and 405*c*. In addition, polyacetal resin (POM) was used as the material of the liquid absorbing pressing members 105*b*, 205*b*, 305*b*, and 405*b*, and the shape was adjusted. The pressure was 3 kg/cm$^2$.

Thereafter, in relation to the transfer type ink jet recording apparatus shown in FIG. 1 or FIG. 2, while the ink image after liquid removal was in contact with the recording medium 108 or 208, the pressing member 106 or 206 for transferring pressed the transfer body 101 or 201. Due to this, the ink image after liquid removal was transferred onto the recording media 108 and 208 to form an image. The pressure during transfer was 10 kg/cm$^2$, and the transfer time was 50 ms (milliseconds).

Evaluation of Smeared Images

The obtained image was observed and the smeared image was evaluated according to the following criteria. The results are shown in Table 1 and Table 2.

A: There is no image disturbance due to sweeping in the entire image.

B: There is no image disturbance except for slight sweeping confirmed at the rear end portion of the image.

C: Image disturbance due to sweeping is confirmed throughout the entire image.

Example 1

A transfer type ink jet recording apparatus shown in FIG. 1 was used. When the transfer body 101 and the liquid absorbing member 105*a* started to come into contact with each other (at the contact start position), the curvature radius R1 of the transfer body 101 was set to 440 mm and the curvature radius R2 of the liquid absorbing member 105*a* was set to −570 mm. In addition, when the transfer body 101 and the liquid absorbing member 105*a* were separated (at the separated position), a curvature radius R3 of the transfer body 101 was set to 440 mm and a curvature radius R4 of the liquid absorbing member 105*a* was set to −570 mm. These were adjusted by adjusting the shapes of the support member 102 and the liquid absorbing pressing member 105*b*. At this time, |R1|/|R2| was 0.77. With respect to the image obtained in this example, the smeared image was evaluated by the above method. The results are shown in Table 1.

Examples 2 to 12 and Comparative Examples 1 to 4

Images were formed and evaluated in the same manner as in Example 1 with the exception that the image formation was performed under the conditions shown in Table 1 and Table 2. The results are shown in Table 1 and Table 2. In Example 3, the surface of the liquid absorbing member 105*a* when the transfer body 101 and the liquid absorbing member 105*a* were separated was a surface at a tangent with respect to the curved surface of the transfer body 101.

TABLE 1

| | Example 1 | Example 2 | Example 3 | Example 4 | Example 5 | Example 6 | Example 7 | Example 8 |
|---|---|---|---|---|---|---|---|---|
| Method | Transfer type | Transfer type | Transfer type | Transfer type | Transfer type | Transfer type | Transfer type | Transfer type |
| Diagram | FIG. 1 | FIG. 1 | FIG. 1 | FIG. 1 | FIG. 1 | FIG. 2 | FIG. 2 | FIG. 2 |
| R1 (mm) | 440 | 440 | 440 | 440 | 440 | −570 | −550 | −460 |
| R2 (mm) | −570 | −570 | −570 | −550 | −460 | 440 | 440 | 440 |
| R3 (mm) | 440 | 440 | 440 | 440 | 440 | −570 | −550 | −460 |
| R4 (mm) | −570 | 440 | — | −550 | −460 | 440 | 440 | 440 |
| \|R1\|/\|R2\| | 0.77 | 0.77 | 0.77 | 0.80 | 0.96 | | | |
| \|R2\|/\|R1\| | | | | | | 0.77 | 0.80 | 0.96 |
| Smeared image evaluation | B | B | B | A | A | B | A | A |

TABLE 2

| | Example 9 | Example 10 | Example 11 | Example 12 | Comparative Example 1 | Comparative Example 2 | Comparative Example 3 | Comparative Example 4 |
|---|---|---|---|---|---|---|---|---|
| Method | Direct drawing type | Direct drawing type | Direct drawing type | Direct drawing type | Transfer type | Transfer type | Transfer type | Transfer type |
| Diagram | FIG. 3 | FIG. 3 | FIG. 4 | FIG. 4 | FIG. 1 | FIG. 2 | FIG. 1 | FIG. 2 |
| R1 (mm) | 440 | 440 | −570 | −460 | 440 | −440 | 570 | −440 |
| R2 (mm) | −570 | −460 | 440 | 440 | 570 | −570 | −440 | 570 |
| R3 (mm) | 440 | 440 | −570 | −460 | 440 | −440 | 570 | −440 |
| R4 (mm) | −570 | −460 | 440 | 440 | 570 | −570 | −440 | 570 |
| \|R1\|/\|R2\| | 0.77 | 0.96 | 0.77 | 0.96 | 0.77 | | 1.30 | |
| \|R2\|/\|R1\| | | | | | | 1.30 | | 1.30 |
| Snared image evaluation | B | A | B | A | C | C | C | C |

As shown in Examples 1 to 12, when the ink receiving medium and the liquid absorbing member come into contact with each other (at the contact start position), in a case where the curvature radius R1 of the ink receiving medium and the curvature radius R2 of the liquid absorbing member satisfy the following relationship, it is clear that the effect of suppressing smeared images is obtained.

R1>0, R2<0, and |R1|≤|R2|, or R1<0, R2>0, and |R1|≥|R2|.

In addition, it is understood that when |R1|/|R2| is 0.8 or more in a case where R1>0 and |R2|/|R1| is 0.8 or more in a case where R1<0, an effect of further suppressing smeared images is obtained. On the other hand, in Comparative Examples 1 and 2, since R1 and R2 are not in a positive/negative relationship, convex parts of the ink receiving medium and the liquid absorbing member come into contact with each other, a high pressure is applied, and smeared images are generated. In addition, in Comparative Examples 3 and 4, even if R1 and R2 are in a positive/negative relationship, in a case where the absolute value does not satisfy the above relationship, the end portion of the arc of the liquid absorbing member contacts the ink receiving medium at the contact start time, a high pressure is applied, and smeared images are generated. As described above, according to the present embodiment, it is understood that it is possible to suppress smeared images and form satisfactory images.

According to the present invention, it is possible to provide an ink jet recording apparatus and an ink jet recording method capable of suppressing smeared images and forming a satisfactory image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131280, filed Jul. 4, 2017, which is hereby incorporated by reference herein in its entirety.

What is claimed is:

1. An ink jet recording apparatus comprising:

a transfer member which rotates cyclically;

an image forming unit for forming an ink image containing a liquid component and a coloring material on the transfer member;

a liquid absorbing unit having a liquid absorbing member which absorbs at least a part of the liquid component from the ink image; and a pressing member which presses the liquid absorbing member from a surface of the liquid absorbing member opposite to a surface of the liquid absorbing member being in contact with the ink image toward the transfer member, wherein before a transfer operation of transferring the ink image formed on the transfer member to a print medium, in a state of the liquid absorbing member being pressed by the pressing member, when, in a moving direction of the transfer member, a curvature radius of the transfer member at a contact start position between the liquid absorbing member and the transfer member is defined as R1, and a curvature radius of the liquid absorbing member at the contact start position is defined as R2, (a) a center of the curvature radius R2 is located on the transfer member side with respect to the liquid absorbing member at the contact start position, and (b) a relationship in which R1>0, R2<0, and |R1|<|R2| is satisfied.

2. The ink jet recording apparatus according to claim 1, wherein |R1|/|R2| is 0.8 or more.

3. The ink jet recording apparatus according to claim 1, wherein the liquid absorbing member is an endless liquid absorbing sheet.

4. The ink jet recording apparatus according to claim 1, wherein the ink jet recording apparatus further comprises a transfer pressing member for transferring an ink image, in which at least a part of the liquid component is removed by the liquid absorbing member, onto a recording medium.

5. The ink jet recording apparatus according to claim 1, wherein the ink receiving medium is a recording medium.

6. The ink jet recording apparatus according to claim 1, wherein the liquid absorbing unit comprises a plurality of extending members for extending the liquid absorbing member and the pressing member presses a region between the plurality of extending members of the liquid absorbing unit.

7. An ink jet recording method comprising:

an image forming step of forming an ink image containing a liquid component and a coloring material on a transfer member which rotates cyclically; and a liquid absorbing step of absorbing at least a part of the liquid component from the ink image by pressing, with a pressing member, a liquid absorbing member from a surface of the liquid absorbing member opposite to a surface of the liquid absorbing member being in contact with the ink image toward the transfer member, wherein before a transfer operation of transferring the ink image formed on the transfer member to a print medium, in a state of the liquid absorbing member being pressed by the Dressing member, when, in a moving direction of the transfer member, a curvature radius of the transfer member at a contact start position between the liquid absorbing member and the transfer member is defined as R1, and a curvature radius of the liquid absorbing member at the contact start position is defined as R2, (a) a center of the curvature radius R2 is located on the transfer member side with respect to the liquid absorbing member at the contact start position, and (b) a relationship in which R1>0, R2<0, and |R1|<|R2| is satisfied.

8. The ink jet recording method according to claim 7, wherein |R1|/|R2| is 0.8 or more.

9. The ink jet recording method according to claim 7, wherein the liquid absorbing member is an endless liquid absorbing sheet.

10. The ink jet recording method according to claim 7, wherein the ink jet recording apparatus further comprises a transfer pressing member for transferring an ink image, in which at least a part of the liquid component is removed by the liquid absorbing member, onto a recording medium.

11. The ink jet recording method according to claim 7, wherein the ink receiving medium is a recording medium.

* * * * *